US007641449B2

(12) United States Patent
Iimura et al.

(10) Patent No.: US 7,641,449 B2
(45) Date of Patent: Jan. 5, 2010

(54) AIR COMPRESSOR HAVING A CONTROLLER FOR A VARIABLE SPEED MOTOR AND A COMPRESSED AIR TANK

(75) Inventors: Yoshio Iimura, Ibaraki (JP); Hiroaki Orikasa, Ibaraki (JP); Mitsuhiro Sunaoshi, Ibaraki (JP); Kazuhiro Segawa, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 976 days.

(21) Appl. No.: 10/873,165

(22) Filed: Jun. 23, 2004

(65) Prior Publication Data

US 2004/0265134 A1 Dec. 30, 2004

(30) Foreign Application Priority Data

Jun. 24, 2003 (JP) ..... P2003-178944

(51) Int. Cl.
*F04B 49/00* (2006.01)
*F04B 49/06* (2006.01)

(52) U.S. Cl. ..... 417/12; 417/18; 417/44.2; 417/326

(58) Field of Classification Search ..... 417/44.1, 417/12, 32, 326, 44.11, 18; 60/409, 410, 60/418

See application file for complete search history.

(56) References Cited

U.S. PATENT DOCUMENTS

| | | | | |
|---|---|---|---|---|
| 4,863,355 | A * | 9/1989 | Odagiri et al. | 417/12 |
| 6,068,447 | A * | 5/2000 | Foege | 417/12 |
| 6,089,835 | A | 7/2000 | Suzuura et al. | |
| 6,287,083 | B1 * | 9/2001 | Hase et al. | 417/216 |
| 7,118,348 | B2 * | 10/2006 | Dean et al. | 417/12 |

FOREIGN PATENT DOCUMENTS

| | | |
|---|---|---|
| JP | 4-296505 | 10/1992 |

* cited by examiner

*Primary Examiner*—Charles G Freay
(74) *Attorney, Agent, or Firm*—McGinn IP Law Group, PLLC

(57) ABSTRACT

For a motor that drives a compressed air generator, three operating modes which includes a powerful mode for rotating a motor in a high speed range, a silent mode for rotating the motor in a low speed range, and an automatic mode for automatically changing the rotation speed of the motor from the low speed to the high speed in accordance with a setup condition are prepared. A user can designate a desired operating mode by using an operating mode selection switch.

13 Claims, 11 Drawing Sheets

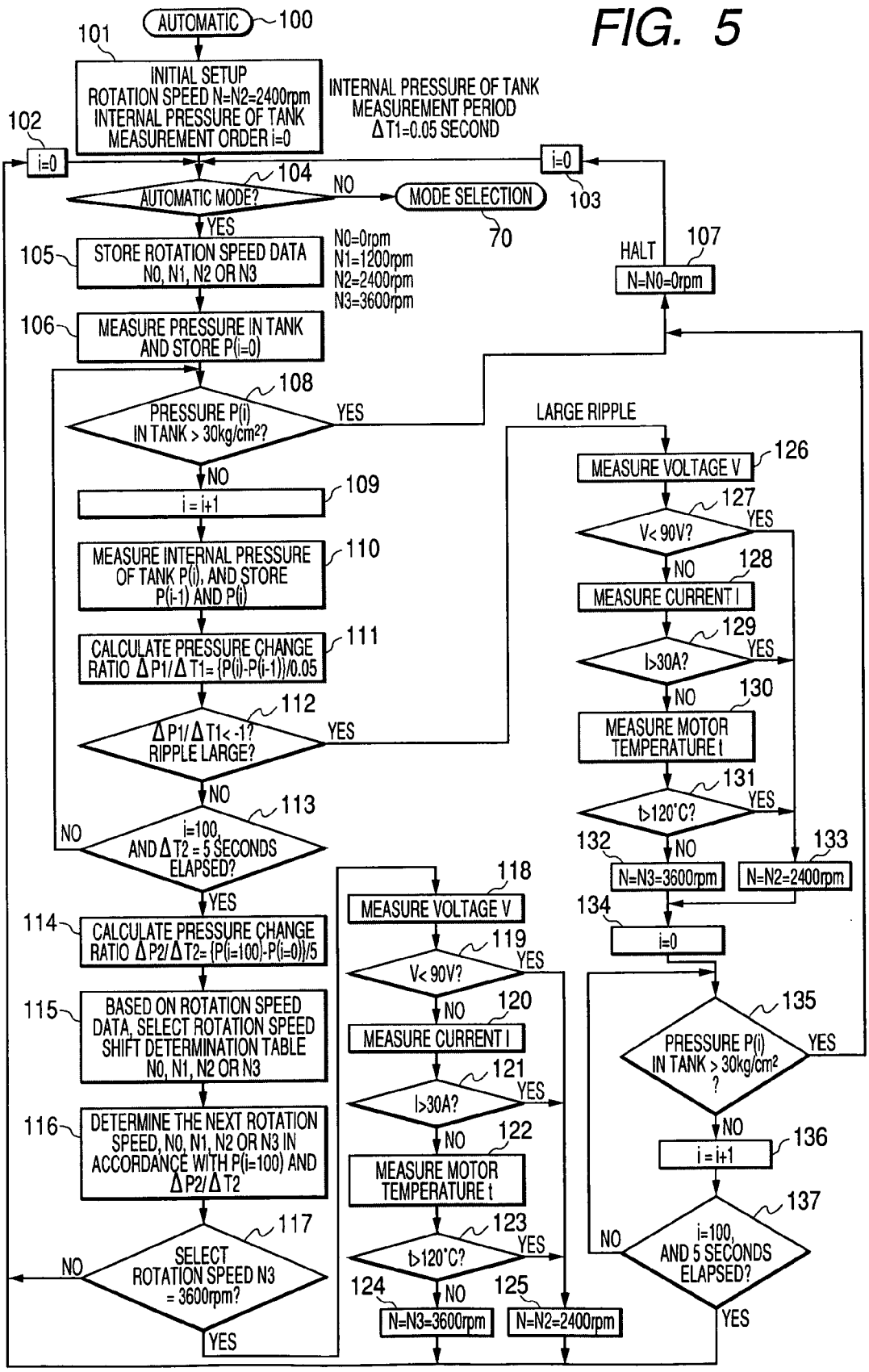
FIG. 5
AUTOMATIC
100
101
INITIAL SETUP
ROTATION SPEED N=N2=2400rpm
INTERNAL PRESSURE OF TANK
MEASUREMENT ORDER i=0
INTERNAL PRESSURE OF TANK
MEASUREMENT PERIOD
ΔT1=0.05 SECOND
102
i=0
i=0
103
104
AUTOMATIC MODE?
NO
MODE SELECTION
70
YES
105
STORE ROTATION SPEED DATA
N0, N1, N2 OR N3
N0=0rpm
N1=1200rpm
N2=2400rpm
N3=3600rpm
HALT
107
N=N0=0rpm
106
MEASURE PRESSURE IN TANK
AND STORE P(i=0)
108
PRESSURE P(i)
IN TANK > 30kg/cm²?
YES
LARGE RIPPLE
NO
109
i = i+1
110
MEASURE INTERNAL PRESSURE
OF TANK P(i), AND STORE
P(i-1) AND P(i)
111
CALCULATE PRESSURE CHANGE
RATIO ΔP1/ΔT1= {P(i)-P(i-1)}/0.05
112
ΔP1/ΔT1< -1?
RIPPLE LARGE?
YES
NO
113
i=100,
AND ΔT2 = 5 SECONDS
ELAPSED?
NO
YES
114
CALCULATE PRESSURE CHANGE
RATIO ΔP2/ΔT2= {P(i=100)-P(i=0)}/5
115
BASED ON ROTATION SPEED
DATA, SELECT ROTATION SPEED
SHIFT DETERMINATION TABLE
N0, N1, N2 OR N3
116
DETERMINE THE NEXT ROTATION
SPEED, N0, N1, N2 OR N3 IN
ACCORDANCE WITH P(i=100) AND
ΔP2/ΔT2
117
SELECT
ROTATION SPEED N3
= 3600rpm?
NO
YES
118
MEASURE VOLTAGE V
119
V< 90V?
YES
NO
120
MEASURE CURRENT I
121
I>30A?
YES
NO
122
MEASURE MOTOR
TEMPERATURE t
123
t>120°C?
YES
124
NO
125
N=N3=3600rpm
N=N2=2400rpm
126
MEASURE VOLTAGE V
127
V< 90V?
YES
NO
128
MEASURE CURRENT I
129
I>30A?
YES
NO
130
MEASURE MOTOR
TEMPERATURE t
131
t>120°C?
YES
NO
132
133
N=N3=3600rpm
N=N2=2400rpm
134
i=0
135
PRESSURE P(i)
IN TANK > 30kg/cm²
?
YES
NO
136
i = i+1
137
i=100,
AND 5 SECONDS
ELAPSED?
NO
YES

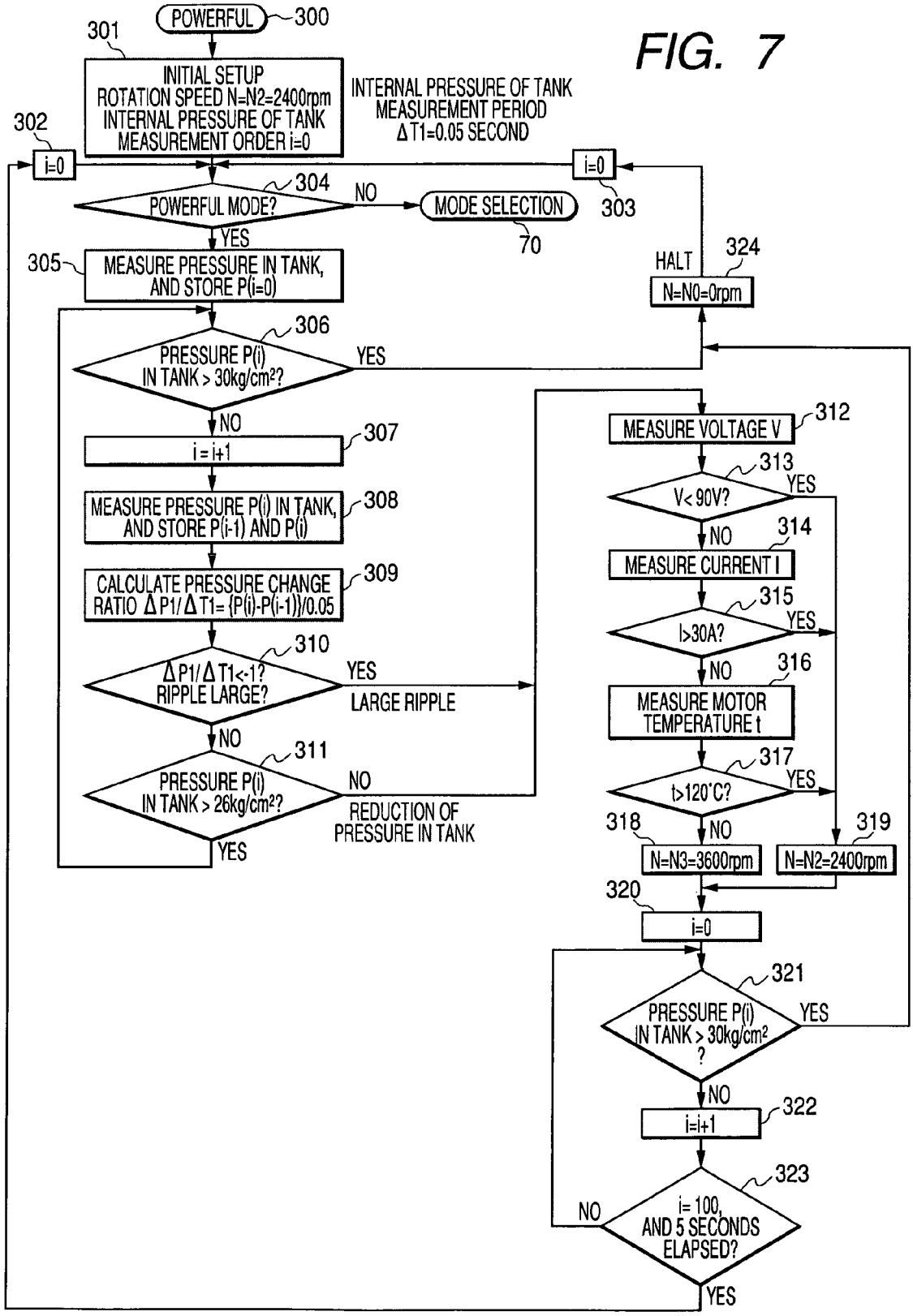
FIG. 7
POWERFUL
300
301
INITIAL SETUP
ROTATION SPEED N=N2=2400rpm
INTERNAL PRESSURE OF TANK
MEASUREMENT ORDER i=0
INTERNAL PRESSURE OF TANK
MEASUREMENT PERIOD
ΔT1=0.05 SECOND
302
i=0
i=0
303
304
POWERFUL MODE?
NO
MODE SELECTION
70
YES
305
MEASURE PRESSURE IN TANK,
AND STORE P(i=0)
HALT
324
N=N0=0rpm
306
PRESSURE P(i)
IN TANK > 30kg/cm²?
YES
NO
307
i = i+1
MEASURE PRESSURE P(i) IN TANK,
AND STORE P(i-1) AND P(i)
308
CALCULATE PRESSURE CHANGE
RATIO ΔP1/ΔT1= {P(i)-P(i-1)}/0.05
309
310
ΔP1/ΔT1<-1?
RIPPLE LARGE?
YES
LARGE RIPPLE
NO
311
PRESSURE P(i)
IN TANK > 26kg/cm²?
NO
REDUCTION OF
PRESSURE IN TANK
YES
MEASURE VOLTAGE V
312
313
V< 90V?
YES
NO
314
MEASURE CURRENT I
315
I>30A?
YES
NO
316
MEASURE MOTOR
TEMPERATURE t
317
t>120°C?
YES
NO
318
N=N3=3600rpm
319
N=N2=2400rpm
320
i=0
321
PRESSURE P(i)
IN TANK > 30kg/cm²
?
YES
NO
322
i=i+1
323
i= 100,
AND 5 SECONDS
ELAPSED?
NO
YES ROTATION SPEED SHIFT DETERMINATION TABLE
N1 (=1200rpm)

ROTATION SPEED SHIFT DETERMINATION TABLE
N0 (=0rpm)

AIR COMPRESSOR HAVING A CONTROLLER FOR A VARIABLE SPEED MOTOR AND A COMPRESSED AIR TANK

BACKGROUND OF THE INVENTION

1. Field of the Invention

The present invention relates to an air compressor for compressing air and is applied for the operation of a pneumatic tool, such as a nailer, and a control method therefor.

2. Description of the Related Art

An air compressor applied for the operation of pneumatic tools is generally designed so that as a motor rotates a crankshaft in the main body of the air compressor, a piston served by the crankshaft reciprocates within a cylinder and compresses air supplied via an intake valve. Thereafter, the compressed air is discharged from the main body of the air compressor, through an air release valve and a pipe, to an pressure tank for storage. The compressed air stored in this tank can then be applied for the operation of pneumatic tools used for nailing.

Since air compressors are frequently employed outdoors, such as at construction sites or in locations whereat houses are constructed close together, the present inventors, based on various perspectives, determined that improvements were advisable. Thus, we performed research to evaluate the performance of air compressors under actual prevailing encountered in various situations, and as a result, to delineate the user requests and technical problems we encountered during our research, we decided to use the following categories.

(1) Noise Reduction

Since an air compressor includes a mechanism for converting the rotation of a motor into the reciprocal movement of a piston in a cylinder, the generation of considerable noise can not be avoided. Further, since a nailer that uses air compressed by an air compressor also generates noise while in operation, there is considerable noise pollution, and physical discomfort, in an area surrounding a construction site whereat both air compressors and pneumatic nailers are being employed. Thus, when such equipment is to be used early in the morning or late in the evening at locations whereat houses are constructed close together, the request for maximum noise reduction is expressed especially strong.

(2) Increased Power and Efficiency

Locations whereat air compressors are employed are not always satisfactory power supply environments; on the contrary, air compressors are frequency used in environments wherein sufficiently high voltages can not be obtained because long cords, stretched from other locations, are employed to supply power, or in environments wherein voltages fluctuate because multiple tools are in use at the same time.

Therefore, occasionally, high power can not be output by an air compressor, and when, for example, nailers are employed while the power output is insufficient, a so-called poor nail holding phenomenon can occur and nails can not be set well in the material being processed.

Usually, air is stored in the air compressor pressure tank at a pressure of from 26 to 30 kg/cm$^2$, and during a period wherein no-tools are being employed, air leakage can not be avoided. Thus, dependant on the air usage, a reduction in efficiency occurs.

(3) Improvement in Size Reduction and Portability

While some of the air compressors used for pneumatic tools are of a stationary type, most air compressors are portable, and can be carried to and employed at construction sites. Therefore, a need has been expressed for minimum sized air compressors for which the portability is excellent. Thus, for compressed air generators, and drive portions therefor, complicated structures should be avoided, and to the extent possible, deterioration of portability should be prevented.

(4) Extension of Service Life

The service life of air compressors for supporting pneumatic tools is shorter than the service life of compressors used for refrigerators and air conditioners. This is understandable, when the severe environmental conditions under which air compressors are used are taken into account. However, longer service life is still demanded that can be attained by restricting, to the extent possible, load fluctuation, or by preventing the unnecessary compression of air.

(5) Suppression of Temperature Rise

Due to the reciprocal movement of a piston in a cylinder and the current flowing to a motor that indirectly drives the piston, an increase in the temperature within an air compressor is unavoidable. However, as the temperature in the air compressor is increased, loss is also increased, and the attainment of high efficiency is prevented. Therefore, a strong demand also exists for the suppression, as quickly as possible, of a rise in the temperature within an air compressor.

SUMMARY OF THE INVENTION

Of the several technical problems involved, the present invention is provided to furnish solutions for problems for which contradictory countermeasures must be taken, i.e., (1) noise reduction and (2) increased power and efficiency.

Specifically, it is one objective of the present invention to provide an air compressor that can constantly be operated at high speed, at high power in an environment wherein operating efficiency is regarded as being the most important factor, such as one wherein houses are widely separated or one wherein the noise level in the immediate vicinity is so large that the noise produced by an air compressor is not a comparatively serious problem.

It is another objective of the present invention to provide an air compressor that can be constantly operated at low speed, at low power in an environment wherein noise reduction is regarded as being the most important factor, such as one wherein the distance between houses is limited or one wherein an air compressor is to be used early in the morning or late in the evening.

It is an additional objective of the present invention to provide an air compressor that, in an environment wherein the noise produced by a tool such as a pneumatic nailer is accepted as necessary, is rotated at low speed, thereby reducing the noise produced, when only a small amount of air is required to operate the pneumatic tool, and that is immediately shifted to fast rotation, to prevent the occurrence of a shortage of power, when a considerable amount of air is required, within a short period of time, to continuously drive concrete nails, for example, or large diameter wood nails.

To achieve these objectives, according to a first feature of the invention, an air compressor includes a tank unit storing an compressed air, a compressed air generator generating the compressed air to be supplied to the tank unit, a drive portion including a motor for driving the compressed air generation portion and a controller portion controlling the drive portion, in which, when motor rotation speed is N0, N1, N2 or N3, where N0=0, and N0<N1<N2<N3, at least two operating modes selected from a group consisting of a silent mode operating the motor at a rotation speed of N0 or N1, a powerful mode operating the motor at a rotation speed of N0, N2 or N3, and an automatic mode operating the motor at a rotation speed of N0, N1, N2 or N3 are enabled.

According to a second feature of the invention, an air compressor includes a tank unit storing a compressed air, a compressed air generator generating the compressed air to be supplied to the tank unit, a drive portion including a motor for driving the compressed air generation portion, a controller portion controlling the drive portion, in which at least two modes selected from a group consisting of a first mode switching the motor between at least two rotation speeds including 0, a second mode switching the motor between at least three rotation speeds including 0, and a third mode switching the motor between at least four rotation speeds including 0 are enabled.

According to a third feature of the invention, the air compressor further includes an operating mode selection switch a user employs to designate the modes.

According to a fourth feature of the invention, the air compressor further includes a pressure sensor detecting a pressure in the tank unit, in which the rotation speed of the motor in a selected mode is changed based on a signal output by the pressure sensor.

According to a fifth feature of the invention, the pressure sensor detects a pressure P in the tank unit at a predetermined period $\Delta T$ interval to obtain $\Delta P/\Delta T$, which is the ratio of a pressure change $\Delta P$ to the predetermined period $\Delta T$, and based on the ratio $\Delta P/\Delta T$, the rotation speed of the motor is changed.

According to a sixth feature of the invention, a detection signal P output by the pressure sensor is calculated to obtain $\Delta P1/\Delta T1$, which is the pressure change ratio for the internal pressure of the tank unit during a relatively short period $\Delta T1$, and $\Delta P2/\Delta T2$, which is the pressure change ratio for the internal pressure of the tank unit during a period $\Delta T2$ that is longer than $\Delta T1$ and, based on information for P, $\Delta P1/\Delta T1$ and $\Delta P2/\Delta T2$, the rotation speed of the motor in the automatic mode or in the third mode is changed.

According to a seventh feature of the invention, a detection signal P output by the pressure sensor is calculated to obtain $\Delta P1/\Delta T1$, which is the pressure change ratio for the internal pressure of the tank unit during a relatively short period $\Delta T1$ and based on the information for P and $\Delta P1/\Delta T1$, the rotation speed of the motor in silent mode or in the first mode is changed.

According to an eighth feature of the invention, a detection signal P output by the pressure sensor is calculated to obtain $\Delta P1/\Delta T1$, which is the pressure change ratio for the internal pressure of the tank unit during a relatively short period $\Delta T1$ and based on the information for P and $\Delta P1/\Delta T1$, the rotation speed of the motor in the powerful mode or in the second mode is changed.

According to a ninth feature of the invention, the air compressor further includes at least one of a temperature sensor detecting temperature of the motor, a voltage sensor detecting a power voltage of the drive portion and a current sensor detecting a current load flowing through the drive portion, in which the rotation speed of the motor is changed based on information contained in detection signals output by both the sensor and the pressure sensor.

According to a tenth feature of the invention, the controller portion has a memory storing information which represents a relationship of the pressure P in the tank unit, a pressure change ratio $\Delta P2/\Delta T2$ and a motor rotation speed N, in which the motor rotation speed is determined by searching the memory.

According to an eleventh feature of the invention, a control method for an air compressor that includes a tank unit storing a compressed air, a compressed air generator generating the compressed air to be supplied to the tank unit, a drive portion including a motor for driving the compressed air generation portion, a pressure sensor detecting a pressure in the tank unit, and a controller portion controlling the drive portion, the method comprising:

selecting one of three operating modes including a powerful mode rotating the motor within a high speed range, a silent mode rotating the motor within a low speed range, and an automatic mode automatically changing the rotation speed within a range extending from a low speed to a high speed in accordance with a setup condition, detecting a pressure P of the compressed air stored in the tank unit and changing the rotation speed of the motor at multiple levels based on a selected operating mode and a detection signal received from the pressure sensor.

According to a twelfth feature of the invention, a control method for an air compressor that includes a tank unit storing a compressed air, a compressed air generator generating the compressed air to be supplied to the tank unit, a drive portion including a motor for driving the compressed air generation portion, a pressure sensor detecting a pressure in the tank unit, and a controller portion controlling the drive portion, the method comprising:

selecting one of three operating modes including a powerful mode rotating the motor within a high speed range, a silent mode rotating the motor within a low speed range, and an automatic mode automatically changing the rotation speed within a range extending from a low speed to a high speed in accordance with a setup condition, detecting a pressure P of the compressed air stored in the tank unit, calculating the detected pressure P to obtain $\Delta P1/\Delta T1$, which is a pressure change ratio for a relatively short period $\Delta T1$, calculating the detected pressure P to obtain $\Delta P2/\Delta T2$, which is the pressure change ratio for a period $\Delta T2$ that is longer than the period $\Delta T1$ and changing a rotation speed of the motor at multiple levels based on a selected operating mode and three types of pressure information including P, $\Delta P1/\Delta T1$ and $\Delta P2/\Delta T2$.

According to a thirteenth feature of the invention, the control method includes detecting a temperature T of the motor and changing the rotation speed of the motor at multiple levels in accordance with the selected operating mode, the three types of pressure information and a detection signal for the temperature T.

According to a fourteenth feature of the invention, the control method includes detecting at least one of a power voltage and a load current of the drive portion and changing the rotation speed of the motor at multiple levels in accordance with at least one of the detected power voltage and the load current, the selected operating mode and the three types of pressure information.

According to a fifteenth feature of the invention, the control method includes employing the tank unit pressure P and the pressure change ratio $\Delta P2/\Delta T2$ to search a table, stored in a memory provided in the controller portion, for the rotation speed of the motor.

BRIEF DESCRIPTION OF THE DRAWINGS

FIG. 5 is a flowchart showing a program used for controlling the air compressor according to the embodiment of the invention.

FIG. 7 is a flowchart showing a program used for controlling the air compressor according to the embodiment of the invention.

DETAILED DESCRIPTION OF THE PREFERRED EMBODIMENTS

The preferred embodiment of the present invention will now be described in detail.

Figure 1:
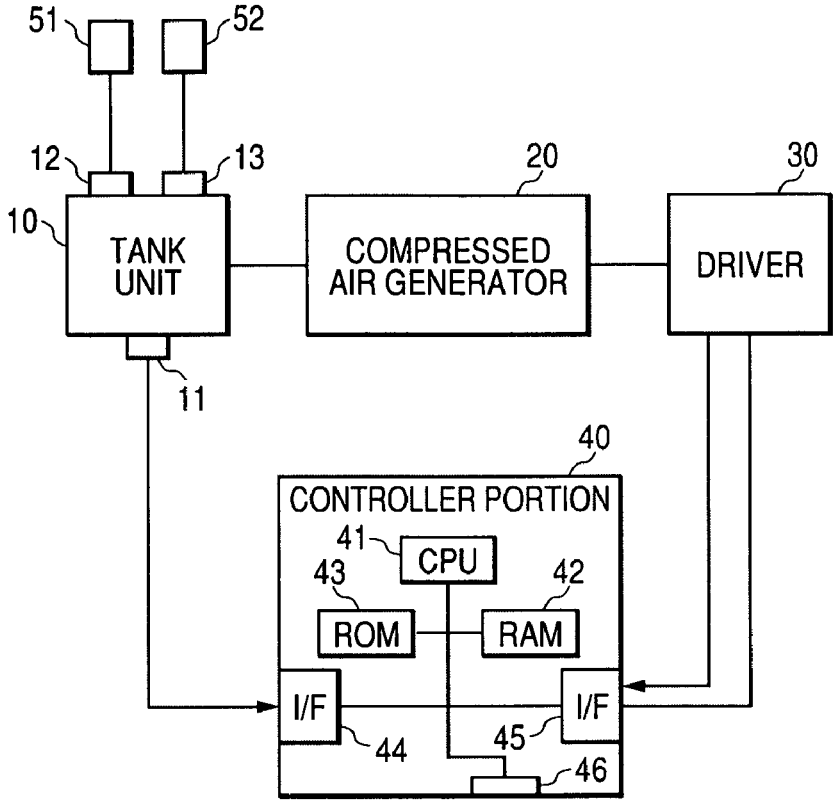
FIG. 1 is a conceptual diagram showing an air compressor according to one embodiment of the present invention.

As is shown in a conceptual diagram in FIG. 1, an air compressor according to the invention comprises: a tank unit 10, for storing compressed air; a compressed air generator 20, for generating compressed air; a drive portion 30, for driving the compressed air generator 20; and a controller portion 40, for controlling the drive portion 30.

(1) Tank Unit 10

Figure 2:
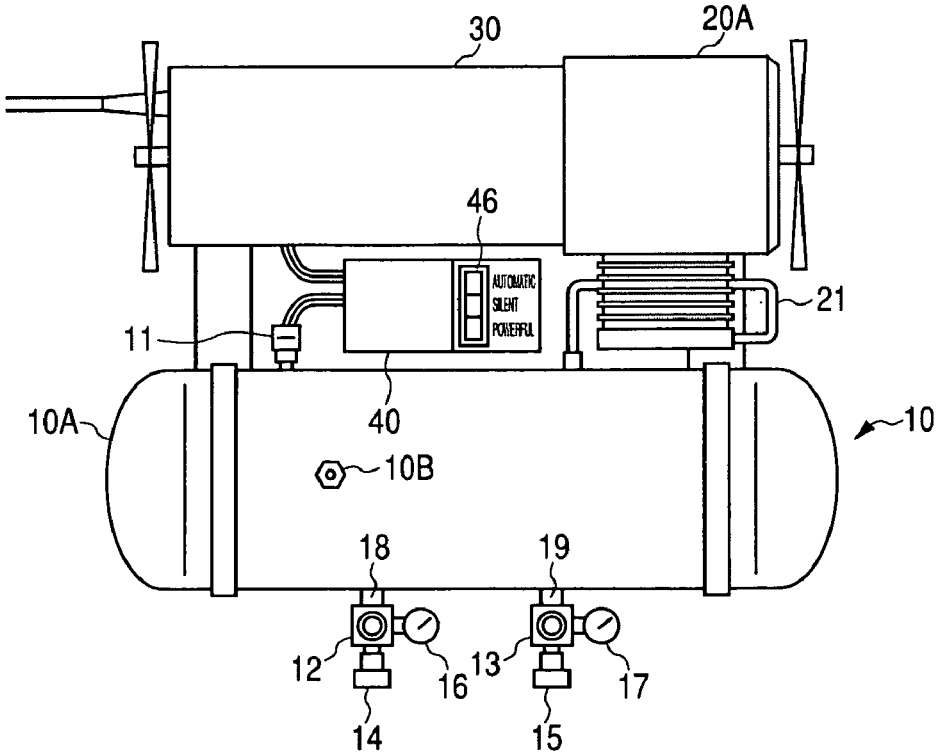
FIG. 2 is a top view of the air compressor according to the embodiment of the invention.

As is shown in FIG. 2, the tank unit 10 includes an pressure tank 10A, for storing compressed air, to which high-pressure, 20 to 30 kg/cm$^2$ compressed air is supplied through a pipe 21 connected to the discharge port of a compressor 20A.

Generally, a plurality of compressed output ports 18 and 19 are provided for the pressure tank 10A, and in this embodiment, the output port 18 is used to feed low-pressure compressed air and the output port 19 is used to feed high-pressure compressed air. The present invention, however, is not limited to this example.

The low-pressure compressed output port 18 is connected through a pressure reducing valve 12 to a low pressure coupler 14. For the pressure reducing valve 12, the maximum pressure for the compressed air is determined on the output side, regardless of the air pressure on the input side. In this embodiment, the designated maximum pressure is a predetermined value ranging from 7 to 10 kg/cm$^2$. Accordingly, compressed air having a pressure of not higher than the maximum pressure can be obtained from the output side of the pressure reducing valve 12 regardless of the pressure in the air tank 10A.

The compressed air output at the pressure reducing valve 12 is supplied, through the low pressure coupler 14, to a low pressure pneumatic tool 51 shown in FIG. 1.

The high-pressure compressed output port 19 is connected through a pressure reducing valve 13 to a high pressure coupler 15. For the pressure reducing valve 13, the maximum pressure for the compressed air is determined on the output side, regardless of the air pressure on the input side. In this embodiment, the designated maximum pressure is a predetermined value ranging of 10 to 30 kg/cm$^2$. Accordingly, compressed air having a pressure of not higher than the maximum pressure can be obtained from the output side of the pressure reducing valve 13. The compressed air output at the pressure reducing valve 13 is supplied, through the high pressure coupler 15, to a high pressure pneumatic tool 52 shown in FIG. 1.

A low pressure gauge 16 and a high pressure gauge 17 are respectively attached to the pressure reducing valves 12 and 13 for monitoring the pressure of the compressed air at the output sides of the pressure reducing valves 12 and 13. In this embodiment, the low pressure coupler 14 and the high pressure coupler 15 vary in size and are not compatible, so as to prevent the high pressure pneumatic tool 52 from being connected to the low pressure coupler 14 and the low pressure pneumatic tool 51 from being connected to the high pressure coupler 15. This configuration was previously disclosed in JP-A-4-296505, submitted by the inventor of the present invention.

Attached to a part of the pressure tank 10A, to detect the pressure of the compressed air stored therein, is a pressure sensor 11 that transmits to the controller portion 40 a detection signal that is used to control a motor, which will be described later. Further, attached to a part of the pressure tank 10A is a safety valve 10B that, to ensure a safe operation, releases stored air when an abnormal increase in the air pressure within the pressure tank 10A is detected.

(2) Compressed Air Generator 20

The compressed air generator 20 is a well known one. In the compressed air generator 20, to supply compressed air, a piston, reciprocating within a cylinder, compresses air that enters the cylinder through an air intake valve. Disclosed in U.S. Pat. No. 6,089,835, submitted by inventor of this invention, is a mechanism that uses a pinion, provided at the distal end of a rotor shaft, and a gear that engages the pinion, to convert the rotation of a motor into the rotation of an output shaft that serves the reciprocating piston.

As the piston reciprocates in the cylinder, air is sucked in through the intake valve located in the cylinder head and compressed. When a predetermined pressure is reached, the compressed air is released through an air outlet valve provided in the cylinder head and is supplied to the pressure tank 10A through the pipe 21 in FIG. 2.

(3) Drive Portion 30

Figure 3:
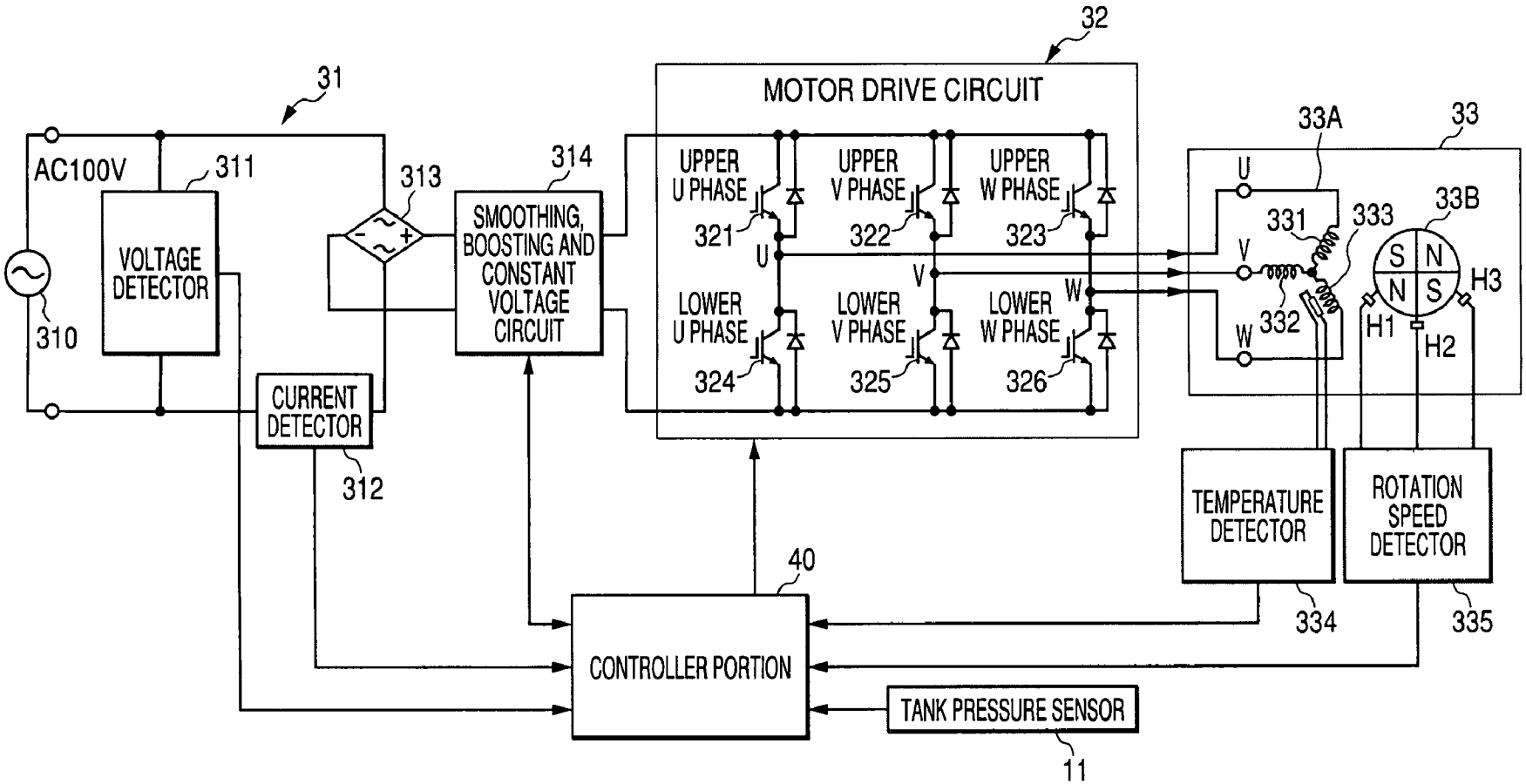
FIG. 3 is a circuit diagram showing the motor drive portion of the air compressor according to the embodiment of the invention.

The drive portion 30 generates a driving force for the reciprocation of the piston, and includes for this purpose, as is shown in FIG. 3, a motor 33, a motor drive circuit 32 and a power supply circuit 31. The power supply circuit 31 includes a rectifier 313, for rectifying the voltage of a 100 V alternating-current power source 310, and a smoothing, boosting and constant voltage circuit 314, for smoothing and boosting the rectified voltage to obtain a constant voltage.

Furthermore, as needed, the power supply circuit 31 includes a voltage detector 311, for detecting voltages at both ends of the power source 310, and a current detector 312, for detecting a current flowing across the power source 310. Signals output by the detectors 311 and 312 are transmitted to the controller portion 40, which will be described later. The detectors 311 and 312 are used to rotate the motor 33 at a super-high speed within an extremely short period in a range wherein the breaker switch (not shown) of the power source 310 is not opened. In this embodiment, however, since the detectors 311 and 312 are not directly related to the control process for the embodiment, no detailed explanation for them will be given. Furthermore, although the controller portion 40 is related to the acquisition of a constant voltage by the constant voltage circuit 314, since the structure of the constant voltage circuit 314 is well known, no detailed explanation for it will be given.

The motor drive circuit 32 includes switching transistors 321 to 326, for employing a direct-current voltage to generate pulse voltages having three phases, a U phase, a V phase and a W phase. The ON/OFF states of the transistors 321 to 326 are controlled by the controller portion 40, and a rotation speed N of the motor 33 is controlled by adjusting the frequency of a pulse signal transmitted to the transistors 321 to 326.

As an example, the rotation speed N of the motor 33 is set at multiple levels times an integer n of a reference value N, e.g., settings for 0 rpm, 1200 rpm, 2400 rpm and 3600 rpm. The motor 33 is rotated at a rotation speed selected from these levels.

Diodes are connected in parallel to the switching transistors 321 to 326 to prevent their destruction due to a counter electromotive force generated by a stator 33A of the motor 33.

The motor 33 includes the stator 33A and a rotor 33B. Provided for the stator 33A are windings 331, 332 and 333, which have a U phase, a V phase and a W phase. A rotating magnetic field is induced when a current is flowing through these windings.

In this embodiment, the rotor 33B is a permanent magnet, and is rotated by the rotating magnetic field that is induced when a current is flowing through the windings 331 to 333 for the stator 33A. A force produced by the rotation the rotor 33B serves as a driving force for the reciprocation of the piston in the compressed air generator 20 (FIG. 1).

The motor 33 also includes a temperature detector 334 for detecting the temperatures of the windings 331 to 333 for the stator 33A, and outputting detection signals to the controller portion 40. As needed, a rotation speed detector 335 is also provided for the motor 33 to detect the rotation speed of the rotor 33B, and for outputting detection signals to the controller portion 40.

(4) Controller Portion 40

As is shown in FIG. 1, the controller portion 40 includes: a central processing unit (hereinafter abbreviated as a CPU) 41, a random access memory (hereafter abbreviated as a RAM) 42, a read only memory (hereinafter abbreviated as a ROM) 43 and an operating mode selection switch 46.

The detection signals output by the pressure sensor 11 and the temperature detector 334 are transmitted across interface circuits (hereafter abbreviated as I/F circuits) 44 and 45 to the CPU 41. An instruction signal output by the CPU 41 is transmitted across the I/F circuit 45 to the motor drive circuit 32 for the drive portion 30 to control the switching transistors 321 to 326 (FIG. 3).

Figure 14A:
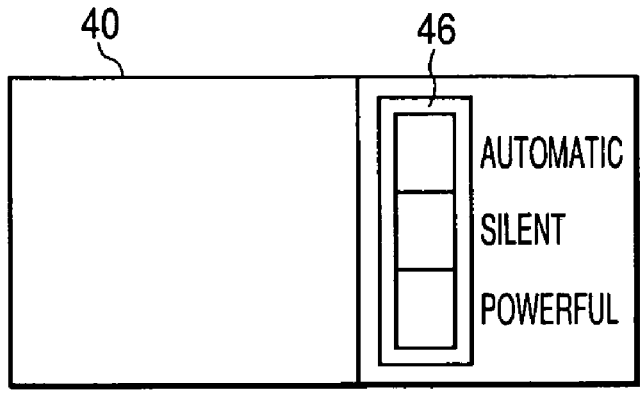
FIGS. 14A to 14C are diagrams for explaining the operating mode selection switch of the air compressor according to the embodiment of the invention.
Figure 14B:
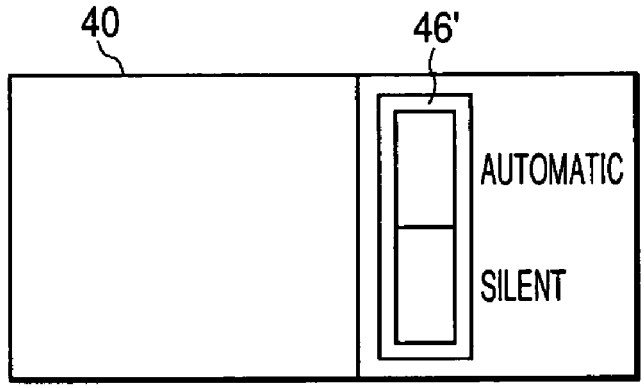
Figure 14C:
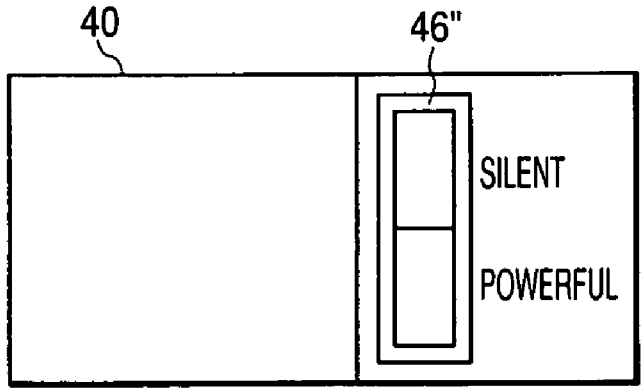

The operating mode selection switch 46 is constituted to enable the selection of three operating modes, a powerful mode, a silent mode and an automatic mode shown in FIG. 14A. In this embodiment, three operating modes can be selected; however, the present invention is not thus limited and can be applied for the selection of one of two modes, the automatic mode and the silent mode shown in FIG. 14B or the silent mode and the powerful mode shown in FIG. 14C. The number of operating modes are determined as needed in accordance with the usage environment.

A mode selection program and a motor control program shown in FIGS. 4, 5, 6 and 7 are stored in the ROM 43, and the RAM 42 is employed for the temporary storage of data required for the execution of the programs and computation results.

(5) Control Program (5.1) Mode Selection

Figure 4:
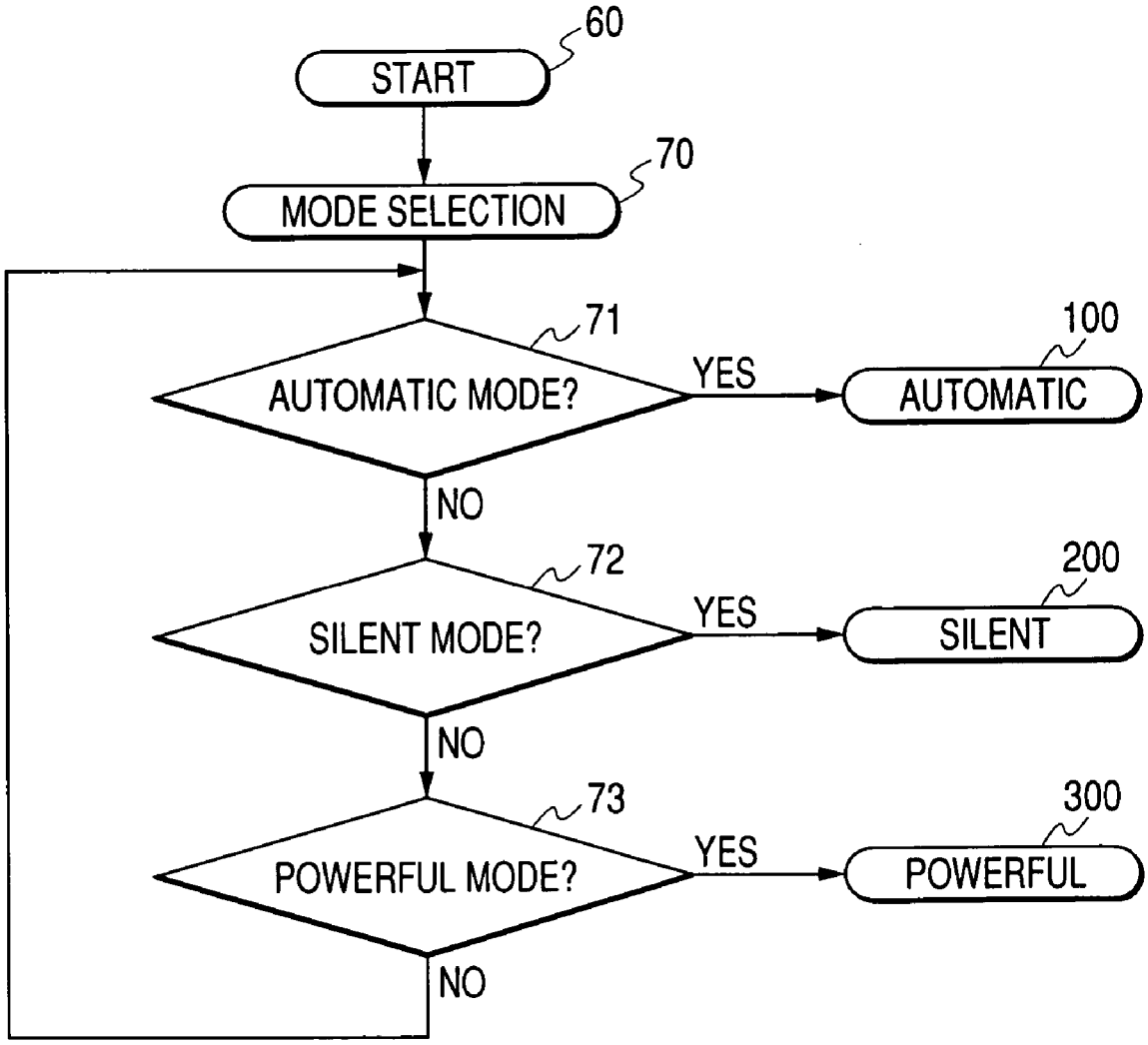
FIG. 4 is a flowchart showing a program used for controlling the air compressor according to the embodiment of the invention.

FIG. 4 is a flowchart for the mode selection program stored in the ROM 43 provided for the controller portion 40 of the invention.

At step 70 in FIG. 4, the operating mode selection switch 46 shown in FIG. 14 is depressed to select an operating mode. At step 71, a check is performed to determine whether the selected mode is the automatic mode. When the decision at step 71 is affirmative (YES), program control jumps to an automatic mode program at step 100 in FIG. 5. When the decision at step 71 is negative (NO), program control advances to step 72.

At step 72, a check is performed to determine whether the silent mode has been selected using the operating mode selection switch 46. When the decision at step 72 is affirmative (YES), program control jumps to a silent mode program at step 200 in FIG. 6. When the decision at step 72 is negative (NO), program control advances to step 73.

At step 73, a check is performed to determine whether the powerful mode has been selected using the operating mode selection switch 46. When the decision at step 73 is affirmative (YES), program control jumps to a powerful mode program at step 300 in FIG. 7. When the decision at all the steps 71, 72 and 73 is negative (NO), the processes at steps 71, 72 and 73 are repeated until an operating mode has been selected.

(5.2) Automatic Mode

FIG. 5 is a flowchart for the automatic mode program stored in the ROM 43 provided for the controller portion 40 of this invention.

In FIG. 5, first, an initial setup is performed at step 101, and N2=2400 rpm is set as the rotation speed N for the motor 33. Further, in order to fetch to the controller portion 40 a signal output by the pressure sensor 11 for the pressure tank 10A, two sampling periods $\Delta T$ are set, i.e., 0.05 second is set for a short period $\Delta T1$, and 5 seconds is set for a long period $\Delta T2$. That is, while i=0, 1, 2, 3, . . . , 100, a difference between P(i−1) and P(i) is calculated to detect a change in the internal tank pressure every 0.05 second, and a difference between P(i=0) and P(i=100) is calculated to detect a change in the pressure every five seconds.

In this embodiment, the short period, for which the setting is 0.05 second, is a period designated for detecting a ripple in the internal tank pressure exerted upon the activation of a nailer that consumes a large amount of air at one time. Since the length of this period also depends on the type of pneumatic tool that is employed, the present invention is not always limited to the time given here. Similarly, the long period, for which the setting is five seconds, is a period designated for detecting a change in the internal tank pressure in accordance with the usage of a pneumatic tool. The timing for this period is merely an example, and the present invention is not limited to the time given.

Then, at step 104, a check is performed to determine whether the automatic mode is still selected. When the decision at step 104 is negative (NO), i.e., when the automatic mode is not still selected, program control jumps to the mode selection at step 70 in FIG. 4. When the decision at step 104 is affirmative (YES), i.e., when the automatic mode is still selected, program control advances to step 105 and data for the rotation speeds employed for controlling the air compressor of the invention is stored. In this embodiment, since the rotation speed N of the motor 33 is changed to four levels, N0 (=0 rpm), N1 (1200 rpm), N2 (2400 rpm) and N3 (3600 rpm), the values N0, N1, N2 and N3 are stored in appropriate areas in the RAM 42. More levels can be easily provided for the rotation speed of the motor 33, but at least three levels are preferable.

Following this, at step 106, the pressure P(i) of the compressed air in the pressure tank 10A is measured and stored. At step 108, a check is performed to determine whether the measured pressure P(i) is greater than 30 kg/cm$^2$. When the decision at step 108 is affirmative (YES), program control is shifted to step 107 and the rotation speed N of the motor 33 is set as N0 (0 rpm). That is, in this embodiment, the pressure maintained in the pressure tank 10A is 20 to 30 kg/cm$^2$, and when the internal tank pressure exceeds 30 kg/cm$^2$, the rotation of the motor 33 is halted.

When the decision at step 108 is negative (NO), program control advances to step 109 and (i) is substituted into (i+1). At step 110, the internal tank pressure P(i) is measured and stored with the previously obtained P(i−1). Then, at step 111, the CPU 41 calculates the pressure change ratio ΔP1/ΔT1 for the short period ΔT1 (=(P(i)−P(i−1))/0.05).

At step 112, a check is performed to determine whether the pressure change ratio ΔP1/ΔT1 for the short period ΔT1 is smaller than a predetermined value. Through this process, a check is performed to determine whether a pneumatic tool connected to the pressure tank 10A is currently being employed for an operation, such as continuous nail driving, that consumes a large amount of air in a short period of time. In this embodiment, −1 is set as a predetermined value. When continuous nail driving is performed, the internal tank pressure pulsates, and the ripple in the pressure change becomes larger. And when the reduction of ΔP1 during the period ΔT1 is greater than (−1) (i.e., ΔP1/ΔT1<−1), it is determined, based on the size of the ripple, that the pneumatic tool is currently being employed for an operation like continuous nail driving. Program control thereafter advances to step 126.

At step 126, the voltage (V) at the power source 310 for the power supply circuit 31 (FIG. 3) is detected by the voltage detector 311, and at step 127, a check is performed to determine whether the detected voltage is lower than a predetermined voltage. In this embodiment, the predetermined voltage is set as 90 V. That is, when a large amount of air is to be consumed by the pneumatic tool, it is preferable that the motor 33 immediately be rotated at a higher speed to increase the amount of compressed air that is generated. However, when another pneumatic tool is also connected to the pressure tank 10A and is being employed, the load imposed on the power source 310 will be increased and the breaker switch (not shown) of the power supply circuit 31 (FIG. 3) will be opened. Therefore, to avoid this phenomenon, at step 127, the value of the power supply voltage V is compared with the predetermined value (90 V), and when the decision at step 127 is affirmative (YES), i.e., when the power supply voltage V, which is generally 100 V, is lower than 90 V, it is assumed that another pneumatic tool is also being employed and that a considerable load is being imposed on the power source 310. Therefore, program control is shifted to step 133, and the rotation speed N for the motor 33 is maintained at N2 (=2400 rpm).

When the voltage at the power source 310 is higher than 90 V, program control advances to step 128, where a load current I, flowing through the power supply circuit 31, is detected by the current detector 312. At step 129, a check is performed to determine whether the detected current I is greater than a predetermined value, which, in this embodiment, is 30 A. When the decision at step 129 is affirmative (YES), it is assumed that were the current rotation speed N of the motor 33 increased, the temperature of the winding for the motor 33 would rise excessively, or the breaker switch of the power source 310 would be opened. In this case, program control is also shifted to step 133, and the rotation speed for the motor 33 is maintained at N2 (=2400 rpm).

When the decision at step 129 is negative (NO), program control advances to step 130, and the winding temperature for the stator 331 of the motor 33 is measured. At step 131, a check is performed to determine whether the winding temperature is higher than a predetermined temperature, which in this embodiment is 120° C. Further, although in this embodiment the temperature of the winding for the motor 33 is measured, the temperature at another portion may be measured. When the temperature of the motor winding is higher than 120° C., and the rotation speed of the motor 33 is further increased, the temperature of the motor 33 will rise drastically and hinder the running of the motor 33. In addition, because of the excessive rise in the temperature, considerable deterioration in the compressed air generation efficiency of the compressed air generator 20 will occur. Therefore, when the decision at step 131 is affirmative (YES), program control is also shifted to step 133, and the rotation speed N of the motor 33 maintained as N2 (=2400 rpm).

When the decision at step 131 is negative (NO), program control advances to step 132 and the rotation speed N of the motor 33 is set to N3 (=3600 rpm).

At step 134, i=0 is again set, and at step 135, a check is performed to determine whether the pressure P(i) in the pressure tank 10A is greater than 30 kg/cm$^2$. When the decision at step 135 is affirmative (YES), program control returns to step 107 and the motor 33 is halted. When the decision at step 135 is negative (NO), at step 136, i+1 is replaced with i. Then, at step 137, a check is performed to determine whether i has reached 100, i.e., whether five seconds have elapsed. When the decision at step 137 is affirmative (YES), i=0 is set (step 102) and program control is shifted to step 104. Through the processes performed at steps 135 to 137, the same rotation speed is maintained for the motor 33 for five seconds because an uncomfortable sensation is provided when the rotation speed is changed to N2 and N3 every 0.05 second.

When the decision at step 112 is negative (NO), i.e., when the ratio of the pressure change in the pressure tank 10A for a short period (0.05 second) is smaller than a predetermined value, program control advances to step 112 and a check is performed to determine whether the period ΔT2 (five seconds) has elapsed. When the decision at step 113 is negative (NO), program control returns to step 108. And when the decision at step 113 is affirmative (YES), program control advances to step 114 and the pressure change ratio ΔP2/ΔT2 for a long period (five seconds) (=(P(i=100)−P(i=0))/5) is calculated.

Figure 10:
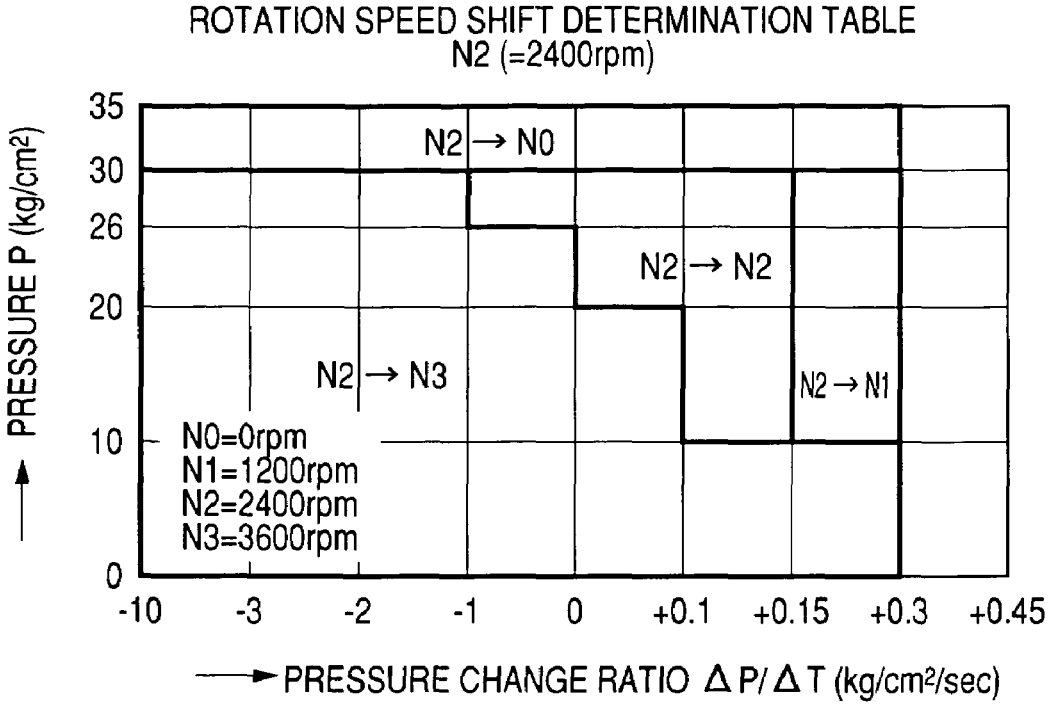
FIG. 10 is a diagram for explaining a rotation speed shift determination table used for controlling the air compressor according to the embodiment of the invention.
Figure 11:
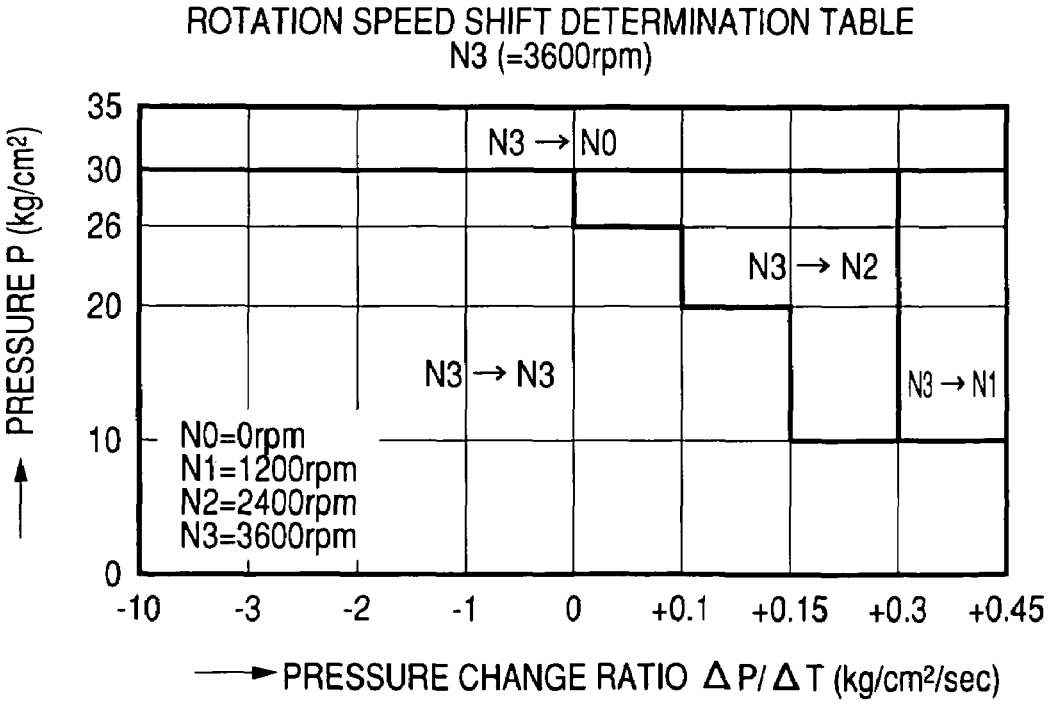
FIG. 11 is a diagram for explaining a rotation speed shift determination table used for controlling the air compressor according to the embodiment of the invention.
Figure 12:
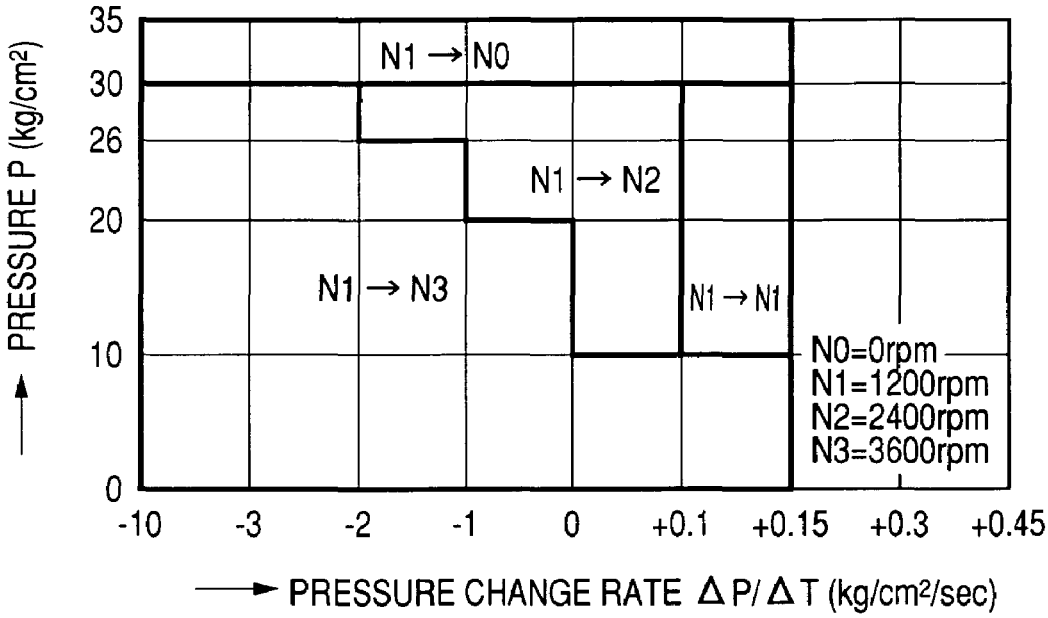
FIG. 12 is a diagram for explaining a rotation speed shift determination table used for controlling the air compressor according to the embodiment of the invention.
Figure 13:
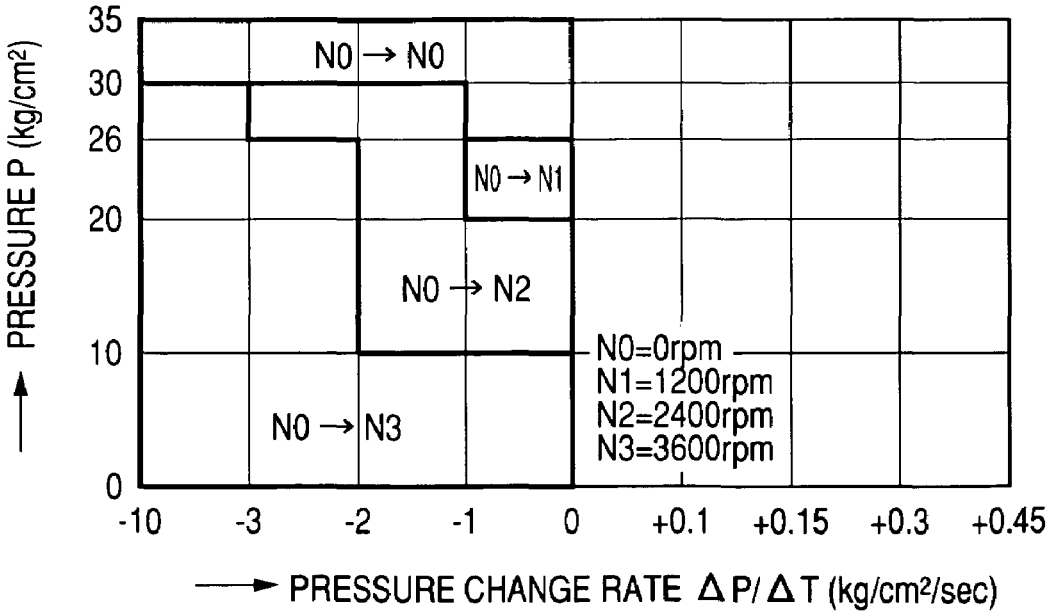
FIG. 13 is a diagram for explaining a rotation speed shift determination table used for controlling the air compressor according to the embodiment of the invention.

At step 115, a rotation speed shift determination table is selected. Four types of rotation speed shift determination tables, shown in FIGS. 10, 11, 12 and 13, are stored in advance in the RAM 42 of the controller portion 40. When the current rotation speed N of the motor 33 is the initial value N2 (=2400 rpm), the table in FIG. 10 is selected. When the current rotation speed N is N3 (=3600 rpm), the table in FIG. 11 is selected. Likewise, when the rotation speed N is N1 or N0, the table in FIG. 12 or the table in FIG. 13 is selected. For these tables, the vertical axis represents the pressure P in the pressure tank 10A, while the horizontal axis represents the internal tank pressure change ratio $\Delta P/\Delta T$. Based on these values, the rotation speed of the motor 33 is determined.

Referring to FIG. 10, when the internal tank pressure P exceeds 30 kg/cm$^2$, the rotation speed N0 is set, regardless of the value of $\Delta P/\Delta T$, i.e., the motor 33 is halted. This is a natural process because the internal tank pressure is constantly maintained within a range of 26 to 30 kg/cm$^2$.

When the pressure change ratio $\Delta P/\Delta T$ is negative, it means that the consumption of compressed air exceeds the supply of compressed air to the pressure tank 10A, and the current rotation speed N2 (=2400 rpm) of the motor 33 is changed to the higher rotation speed N3 (=3600 rpm). Especially when the pneumatic tools 51 and 52 (FIG. 1) are in full operation, the consumption of compressed air is increased and the pressure in the pressure tank 10A drops rapidly. In this embodiment, therefore, the rotation speed is immediately changed to N3 when the pressure change ratio $\Delta P/\Delta T$ is −1 kg/cm$^2$/sec or greater and the internal tank pressure P is 30 kg/cm$^2$ or lower. When the pressure change ratio $\Delta P/\Delta T$ is comparatively small, e.g., 0 to −1 kg/cm$^2$/sec, and when the pressure P in the pressure tank 10A is 26 kg/cm$^2$ or higher, the motor 33 continues to be rotated at the rotation speed N2, and is changed to N3 only when the pressure P in the pressure tank 10A is less than 26 kg/cm$^2$. Furthermore, when the pressure change ratio $\Delta P/\Delta T$ is in a range of 0 to +1 kg/cm$^2$/sec, i.e., when the supply of compressed air slightly exceeds the consumption of compressed air and when the pressure P in the pressure tank 10A is 20 kg/cm$^2$ or greater, the motor 3 continues to be driven at N2, and is changed to N3 only when the pressure P is less than 20 kg/cm$^2$.

When the pressure change ratio $\Delta P/\Delta T$ is within the range +0.1 to +0.15 kg/cm$^2$/sec, it means that the amount of compressed air in the pressure tank 10A is gradually increasing. Thus, when the internal tank pressure P is 10 kg/cm$^2$ or greater, the motor 33 continues to be rotated at N2, and then, is changed to N3 when the pressure P drops below 10 kg/cm$^2$. When the pressure change ratio $\Delta P/\Delta T$ is increased to +0.15 to +0.3 kg/cm$^2$/sec, it is predicted that the internal tank pressure P is rapidly increasing. Therefore, when the pressure P in the pressure tank 10A is 10 kg/cm$^2$ or greater, the rotation speed of the motor 33 is lowered from the current level N2 to N1.

In this explanation, the rotation speed N2 at which the motor 33 is currently running is changed to N0, N3 and N1. When the current rotation speed is N3, N1 or N0, the speed is shifted in accordance with different patterns shown in FIG. 11, 12 or 13.

Next, at step 116, based on the internal tank pressure P(i=100) obtained after five seconds have elapsed and the pressure change ratio $\Delta P2/\Delta T2$ obtained for five seconds, the next rotation speed for the motor 33 is searched for in the selected table and determined. As a result, when the selected rotation speed N is N3 (=3600 rpm) (step 118), instead of immediately changing the rotation speed to N3, a check is performed at steps 118 to 123 to determine whether the power supply voltage V is 90 V or higher, the load current I is 30 A or lower, and the motor winding temperature is 120° C. or lower. Since the processes at steps 118 to 123 are the same as those at steps 126 to 131, no further explanation will be given. Through these processes, the activation of the breaker switch (not shown) and a rapid rise in the temperature of the motor 33 are prevented.

When it is ascertained at steps 118 to 123 that the breaker switch will not be opened and the temperature of the motor 33 will not be raised excessively when the rotation speed N of the motor 33 is changed to the maximum speed of 3600 rpm, program control advances to step 124 and the motor speed is set to N=N3 (=3600 rpm). When the condition at step 119, 121 or 123 is not satisfied, program control is shifted to step 125 and the rotation speed N of the motor 33 is maintained at N2. That is, in this invention, when the pressure change ratio for the short period (0.05 second) or the pressure change ratio for the long period (5 seconds) is large, it is predicted that the consumption of compressed air will be increased, and the rotation speed N of the motor 33 is changed to the higher level N3. However, when a large load is already being imposed on the motor 33 and causes the breaker switch to open or an excessive rise in the temperature of the motor winding, the rotation speed N of the motor 33 is maintained at N2.

(5.3) Silent Mode

Figure 6:
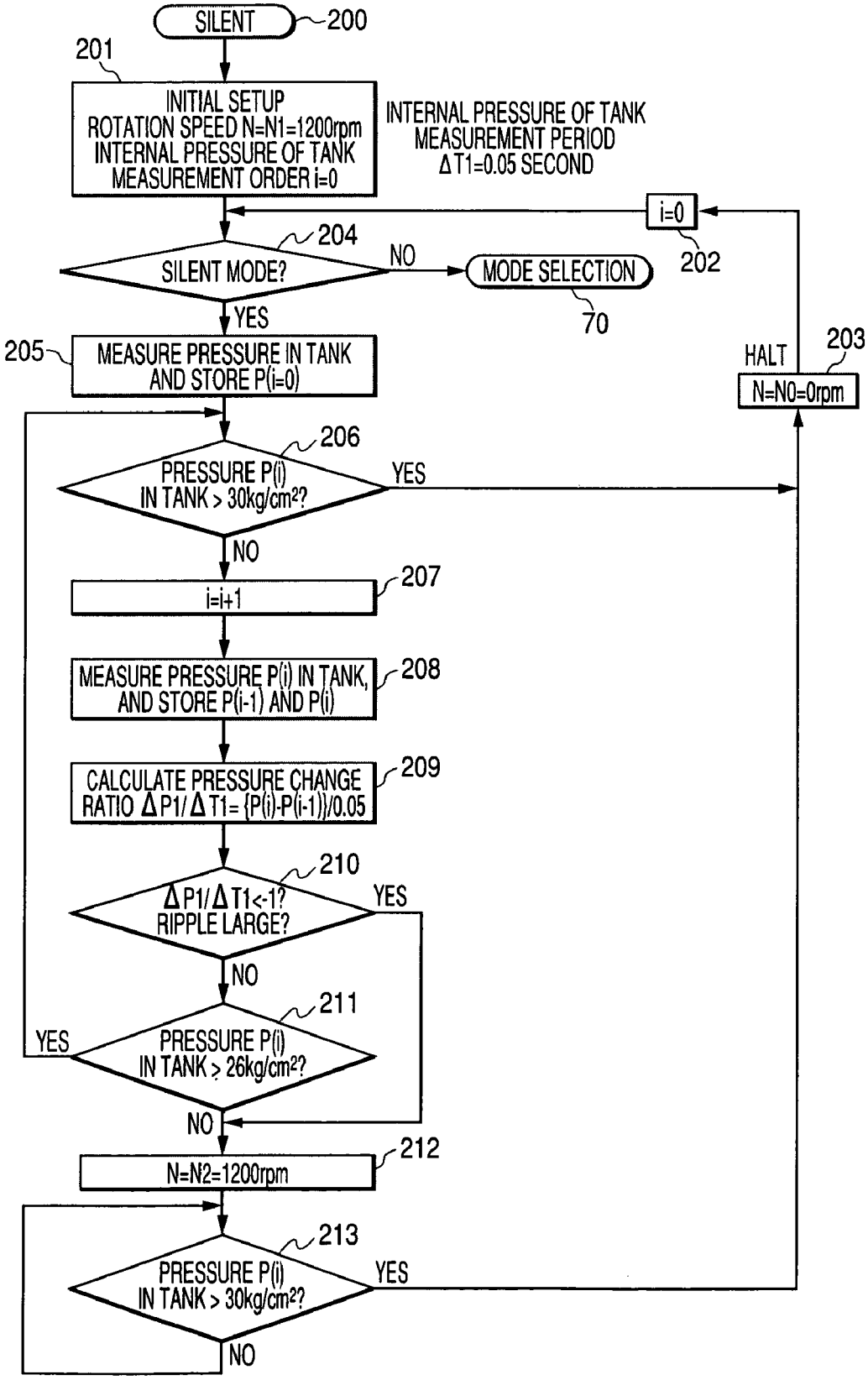
FIG. 6 is a flowchart showing a program used for controlling the air compressor according to the embodiment of the invention.

FIG. 6 is a flowchart showing a silent mode program stored in the ROM 43 of the controller portion 40 of the invention. In the silent mode, the motor 33 is either halted or rotated at the lowest speed N1=1200 rpm.

In FIG. 6, first, an initial setup is performed at step 201, and as the rotation speed N for the motor 33, N1=1200 rpm is set. Further, the sampling period $\Delta T1$ is set as 0.05 second for fetching to the controller portion 40 a signal output by the pressure sensor 11 for the pressure tank 10A. That is, while i=0, 1, 2, 3 . . . , a difference between P(i−1) and P(i) is calculated to detect a change in the internal tank pressure every 0.05 second. In this embodiment, the period $\Delta T1$ is set as 0.05 second, which is used, as previously described, as the timing for the detection of a ripple in the internal tank pressure that is generated upon the activation of a nailer that consumes a large amount of air at one time. Since the value used for this period depends on the type of pneumatic tool that is employed, the present invention is not always limited to the value used here.

Then, at step 204, a check is performed to determine whether the silent mode is still selected. When the decision at step 204 is negative (NO), i.e., when the silent mode is not selected, program control jumps to the mode selection at step 70 in FIG. 4. When the decision at step 204 is affirmative (YES), i.e., when the silent mode is still selected, program control advances to step 205, where the pressure P(i) of the compressed air in the pressure tank 10A is measured and stored. At step 206, a check is performed to determine whether the measured pressure P(i) is greater than 30 kg/cm$^2$. When the decision at step 206 is affirmative (YES), program control is shifted to step 203, and for the rotation speed N of the motor 33, N0 (0 rpm) is set. That is, in this embodiment, a pressure of 20 to 30 kg/cm$^2$ is maintained in the pressure tank 10A, and when the internal tank pressure exceeds 30 kg/cm$^2$, the rotation of the motor 33 is halted.

When the decision at step 206 is negative (NO), program control advances to step 207 and (i) is substituted into (i+1). At step 208, the internal tank pressure P(i) is measured and stored with the previously obtained P(i−1). Then, at step 209, the CPU 41 calculates the pressure change ratio $\Delta P1/\Delta T1$ for the period $\Delta T1$ (=(P(i)−P(i−1))/0.05).

At step 210, a check is performed to determine whether the pressure change ratio $\Delta P1/\Delta T1$ for the short period $\Delta T1$ is smaller than a predetermined value. Through this process, a check is performed to determine whether a pneumatic tool connected to the pressure tank 10A is currently being employed for an operation, such as continuous nail driving, that consumes a large amount of air in a short period of time. In this embodiment, −1 is set as a predetermined value. When continuous nail driving is being performed, the internal tank pressure pulsates, and the ripple in the pressure change becomes larger. And when the reduction of ΔP1 during the period ΔT1 is greater than (−1) (i.e., ΔP1/ΔT1<−1), it is determined, based on the size of the ripple, that the pneumatic tool is currently being employed for an operation like continuous nail driving. Program control thereafter advances to step 212 and the motor 33 is rotated at N1=1200 rpm.

When the decision at step 210 is negative (NO), i.e., when the ratio of the internal tank pressure change for the short period (0.05 second) is smaller than a predetermined value, program control advances to step 211. At step 211, a check is performed to determine whether the measured pressure P(i) is greater than 26 kg/cm$^2$. When the decision at step 211 is affirmative (YES), program control returns to step 206. When the decision at step 211 is negative (NO), i.e., when the internal tank pressure P(i) is 26 kg/cm$^2$ or lower, program control advances to step 212 and the motor 33 is rotated at N1=1200 rpm. That is, through the processes at steps 206 to 212, when the ripple is larger than the predetermined value, the reduction in the pressure to 26 kg/cm$^2$ is not permitted, and the motor 33 is activated immediately after the ripple is detected. Therefore, the reduction in the internal pressure is suppressed.

Then, at step 213, the pressure P(i) is measured, and a check is performed to determine whether the measured pressure P(i) is greater than 30 kg/cm$^2$. When the decision at 213 is affirmative (YES), program control returns to step 203 and the rotation speed N of the motor 33 is set to N0 (0 rpm). When the pressure P(i) is 30 kg/cm$^2$ or smaller, the pressure measurement process is repeated until the pressure P(i) reaches 30 kg/cm$^2$.

(5.4) Powerful Mode

FIG. 7 is a flowchart for a powerful mode program stored in the ROM 43 of the controller portion 40 of this invention. In the powerful mode, the motor 33 is rotated at the high speed N3=3600 rpm or the intermediate speed N2=2400 rpm.

In FIG. 7, first, an initial setup is performed at step 301 and the rotation speed N of the motor 33 is set at N2=2400 rpm. Further, the sampling period ΔT1 is set as 0.05 second for fetching to the controller portion 40 a signal output by the pressure sensor 11 of the pressure tank 10A. That is, while i=0, 1, 2, 3 . . . , a difference between P(i−1) and P(i) is calculated to detect the internal tank pressure change every 0.05 second. In this embodiment, a period of 0.05 second is calculated; however, the present invention is not always limited to this time value.

At step 304, a check is performed to determine whether the powerful mode is still selected. When the decision at step 304 is negative (NO), i.e., the powerful mode is not selected, program control jumps to the mode selection at step 70 in FIG. 4. When the decision at step 304 is affirmative (YES), i.e., the powerful mode is still selected, program control advances to step 305 and the pressure P(i) of compressed air in the pressure tank 10A is measured and stored. At step 306, a check is performed to determine whether the measured pressure P(i) is greater than 30 kg/cm$^2$. When the decision at step 306 is affirmative (YES), program control is shifted to step 324 and the rotation speed N of the motor 33 is changed to N0 (0 rpm). That is, in this embodiment, a pressure of 20 to 30 kg/cm$^2$ is maintained in the pressure tank 10A, and therefore, when this pressure exceeds 30 kg/cm$^2$, the motor 33 is halted.

When the decision at step 306 is negative (NO), program control advances to step 307 and (i) is substituted into (i+1). At step 308, the internal tank pressure P(i) is measured and stored with the previously obtained P(i−1). Then, at step 309, the CPU 41 calculates the pressure change ratio ΔP1/ΔT1 for the period ΔT1 (=(P(i)−P(i−1))/0.05).

At step 310, a check is performed to determine whether the pressure change ratio ΔP1/ΔT1 for the period ΔT1 is smaller than a predetermined value. Through this process, a check is performed to determine whether the pneumatic tool connected to the pressure tank 10A is being employed for an operation, such as continuous nail driving, that consumes a large amount of air in a short period of time. In this embodiment, −1 is set as the predetermined value. When continuous nail driving is being performed, the internal tank pressure pulsates, and the ripple in the pressure change becomes larger. When the reduction of ΔP1 for the period ΔT1 is greater than (−1) (i.e., ΔP1/ΔT1<−1), it is determined, based on the size of the ripple, that the pneumatic tool is currently being employed for an operation such as continuous nail driving. Thereafter, program control advances to step 312.

At step 312, the voltage (V) at the power source 310 in the power supply circuit 31 (FIG. 3) is detected by the voltage detector 311, and at step 313, a check is performed to determine whether the voltage is lower than a predetermined voltage, which in this embodiment is 90 V. When a large amount of air is consumed by the pneumatic tool, it is preferable that the rotation speed of the motor 33 be increased immediately and the amount of compressed air generated be increased. However, when another pneumatic tool is connected to the pressure tank 10A and is being employed, the load imposed on the power source 310 would be is increased, and the breaker switch (not shown) of the power supply circuit 31 would be opened. To avoid this phenomenon, at step 313, the power supply voltage V is compared with the predetermined voltage (90 V). When the decision at step 313 is affirmative (YES), i.e., when the power supply voltage, which is generally 100 V, has dropped to 90 V or lower, it is assumed that another pneumatic tool is also being employed and a considerable load is being imposed on the power source 310. Program control is then shifted to step 319, while the rotation speed N of the motor 33 is maintained at N2 (=2400 rpm).

When the voltage at the power source 310 is 90 V or higher, program control advances to step 314 and the load current I flowing through the power supply circuit 31 is detected by the current detector 312. At step 315, a check is performed to determine whether the measured current I is greater than a predetermined current, which in this embodiment is 30 A. When the decision at step 315 is affirmative (YES), it is assumed that, when the current rotation speed N of the motor 33 is increased, the winding temperature of the motor 33 will rise excessively or the breaker switch of the power source 310 will be opened. In this case, program control is also shifted to step 319, while the rotation speed N of the motor 33 is maintained at N2 (=2400 rpm).

When the decision at step 315 is negative (NO), program control advances to step 316 and the winding temperature of the stator 331 of the motor 33 is measured. At step 317, a check is performed to determine whether the winding temperature is higher than a predetermined temperature, which in this embodiment is 120° C. Further, in this embodiment, the winding temperature of the motor 33 is measured; however, the temperature may be measured at another portion. When the temperature of the motor winding is 120° C. or higher and the rotation speed N of the motor 33 is increased further, the temperature of the motor 33 will rise excessively and hinder the running of the motor 33. Further, due to the excessive rise in the temperature, considerable deterioration of the compressed air generation efficiency of the compressed air generator 20 would occur. Therefore, when the decision at step 317 is affirmative (YES), program control is also shifted to step 319, while the rotation speed N of the motor 33 is maintained at N2 (=2400 rpm).

When the decision at step 317 is negative (NO), program control advances to step 318 and the rotation speed N of the motor 33 is set to N3 (=3600 rpm).

At step 320, i=0 is again set, and at step 321, a check is performed to determine whether the pressure P(i) in the pressure tank 10A is greater than 30 kg/cm$^2$. When the decision at step 321 is affirmative (YES), program control is shifted to step 324, and the motor 33 is halted. When the decision at step 321 is negative (NO), at step 322, i+1 is replaced with i, and at step 323, a check is performed to determine whether i has reached 100, i.e., whether five seconds have elapsed. When the decision at step 323 is affirmative (YES), i=0 is set (step 102) and program control is shifted to step 104. Through the processes performed at steps 135 to 137, the same rotation speed N is maintained for the motor 33 for five seconds because an uncomfortable sensation is provided when the rotation speed is changed to N2 and N3 for every 0.5 seconds.

When the decision at step 310 is negative (NO), i.e., when the ratio of the internal tank pressure change for a short period (0.05 second) is smaller than the predetermined value, program control advances to step 311. At step 311, a check is performed to determine whether the measured pressure P(i) is greater than 26 kg/cm$^2$. When the decision at step 311 is affirmative (YES), program control returns to step 306. When the decision at step 311 is negative (NO), i.e., when the internal tank pressure P(i) is 26 kg/cm$^2$ or smaller, program control also advances to step 312. Through the processes performed at steps 306 to 312, when the ripple is larger than the predetermined value, the reduction of the pressure to 26 kg/cm$^2$ is not permitted, and the motor 33 is activated immediately after the ripple is detected. In this manner, a reduction in the internal pressure is suppressed.

(6) Operation

The operation of the air compressor of the present invention will now be described.

Figure 8:
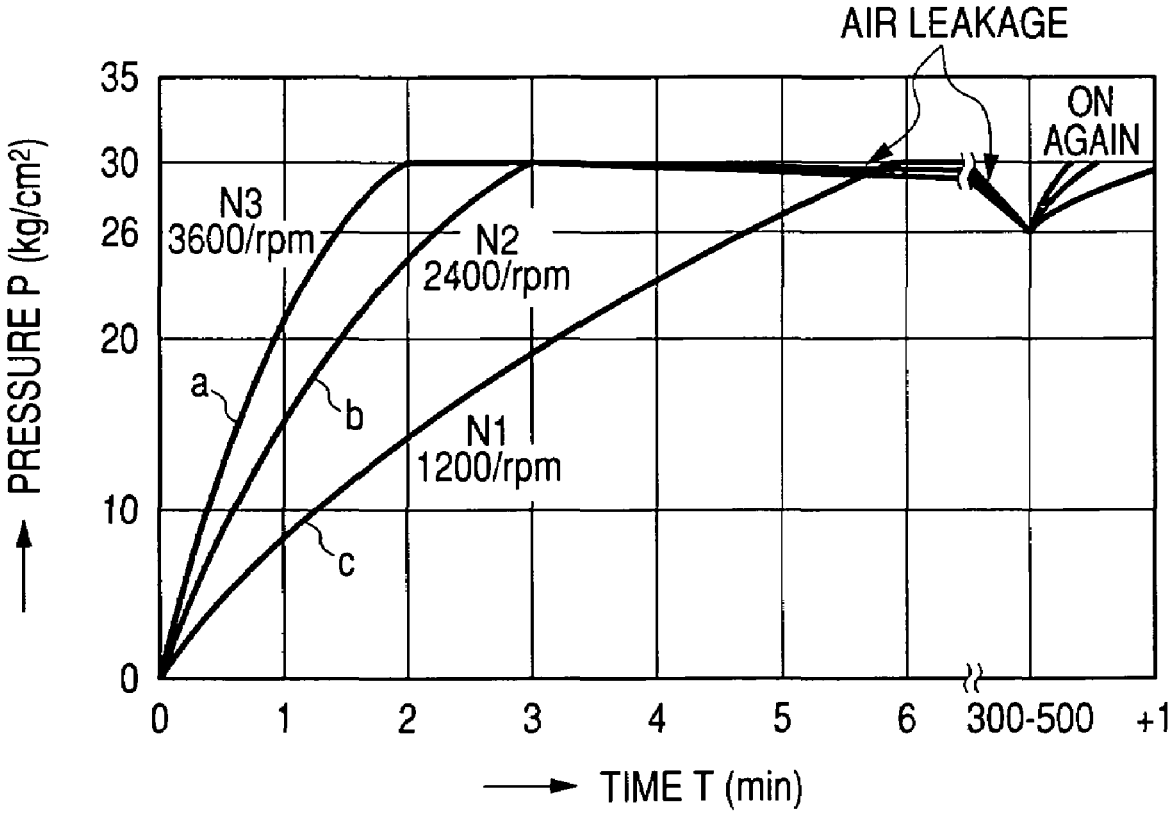
FIG. 8 is a pressure change curve graph for explaining the operation of the air compressor according to the embodiment of the invention.

FIG. 8 is a graph showing curves representing the changes in the internal tank pressure P when the rotation speed is not shifted. In this state, no pneumatic tool is used at all, and a curve a represents the change when the motor 33 is rotated at 3600 rpm, a curve b represents the change when the motor 33 is rotated at 2400 rpm, and a curve c represents the change when the motor 33 is rotated at 1200 rpm. When the initial value of the rotation speed N is 2400 rpm, first, the pressure in the pressure tank 10A is raised along the curve b after the motor switch has been turned on. When about three minutes have elapsed, the pressure reaches 30 kg/cm$^2$, and the motor 33 is halted. When this state is maintained, the compressed air gradually leaks from the pressure tank 10A and the pressure is reduced. When the pressure in the pressure tank 10A has dropped to 26 kg/cm$^2$, the motor 33 is restarted. Similarly, for the curves a and c, the motor 33 is turned off with the pressure of 30 kg/cm$^2$, and is turned on with the pressure of 26 kg/cm$^2$.

The operation of the air compressor of the invention in the automatic mode will now be described while referring to FIG. 9.

Figure 9:
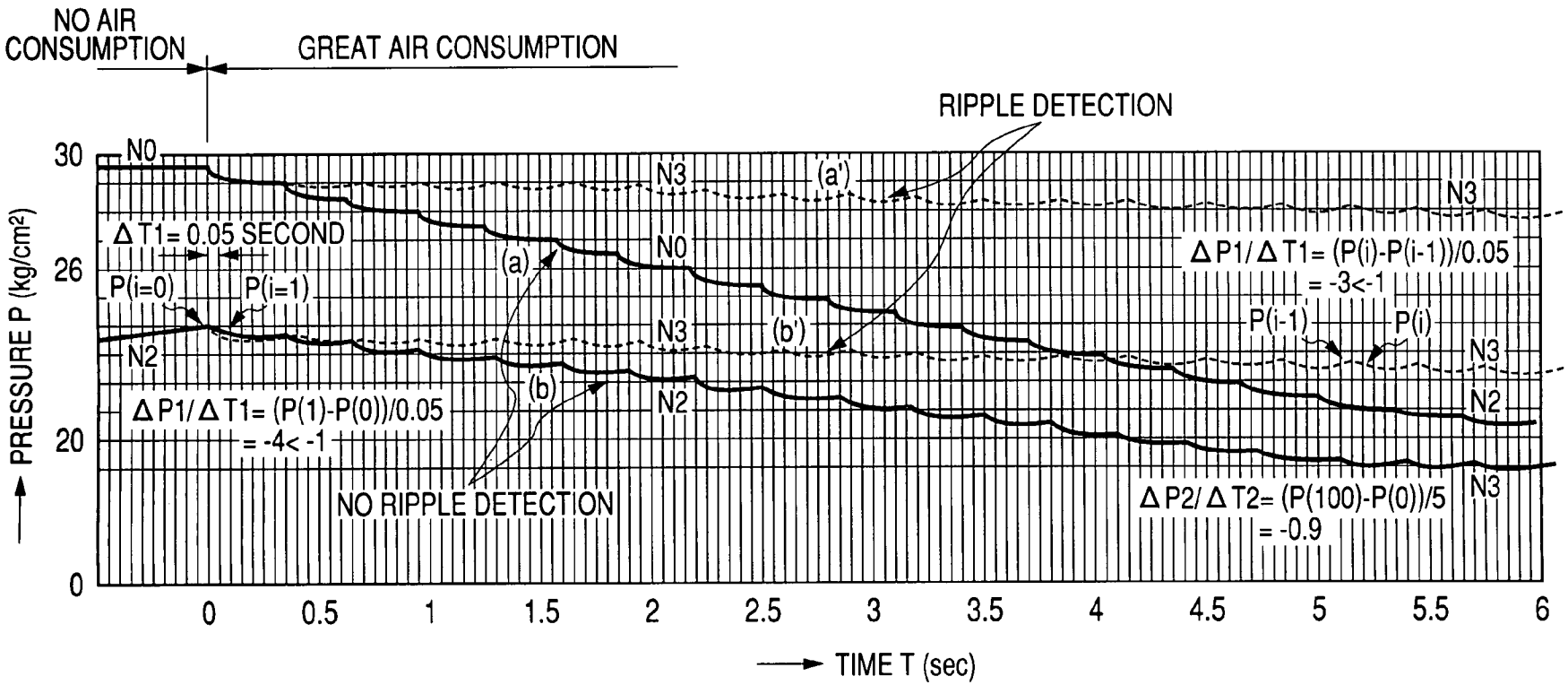
FIG. 9 is a pressure change curve graph for explaining the operation of the air compressor according to the embodiment of the invention.

In the graph in FIG. 9, the horizontal axis represents time, and the vertical axis represents the pressure of the compressed air in the pressure tank 10A. Curves (a) and (b) represent a case wherein no ripple in the internal tank pressure is detected, i.e., when the control is performed in accordance with the pressure-change ratio obtained after the elapse of every long period (five seconds), but not in accordance with the pressure change ratio obtained for every short period (0.05 second). Curves (a') and (b') represent a case wherein the ripple in the internal tank pressure is detected, and the control process is performed in accordance with both pressure change ratios.

According to the curve (a), up to time T=0, the pressure P in the pressure tank 10A is 29 kg/cm$^2$, compressed air is not being consumed, and the motor 33 is halted. When continuous nail driving using, for example, a nailer is started at time T=0, a large amount of air is consumed, and the internal tank pressure pulsates and drops sharply. After T=five seconds has elapsed, the pressure change ratio $\Delta P2/\Delta T2$ is calculated. Since the obtained ratio $\Delta P2/\Delta T2$ is −1.7, the intermediate rotation speed N2=2400 rpm is selected from the rotation speed shift determination table. Therefore, from T=0 second to T=5 seconds, the motor 33 is rotated at N0, and after T=5 seconds, is rotated at N2.

The curve (a') represents a case wherein the ripple detection is performed. Up to time T=0, the internal tank pressure P is 29 kg/cm$^2$, and the motor 33 is halted. When continuous nail driving is begun at time T=0, as well as for the curve a, the internal tank pressure P pulsates and is reduced. However, after $\Delta T1$=0.05 second has elapsed, the pressure change ratio (=$\Delta P1/\Delta T1$) for the ripple is calculated, and since $\Delta P1/\Delta T1=-5<-1$, it is determined that the ripple is large. Furthermore, since the power supply voltage V is 90 V or higher, the load current I is 30 A or smaller and the motor winding temperature t is 120° C. or lower, the motor 33 is shifted immediately to the high rotation speed N3=3600 rpm. Therefore, after $\Delta T1$=0.05 second has elapsed, the motor 33 is rotated at the high speed N3 of 3600 rpm, so that, as indicated by the curve (a'), the reduction in the pressure in the pressure tank 10A is suppressed, and a pressure of close to 29 kg/cm$^2$ is maintained.

According to the curve (b), up to time T=0, the pressure Pin the pressure tank 10A is 26 kg/cm$^2$ or smaller, the compressed air is not consumed, and the motor 33 is rotated at the intermediate speed N2=2400 rpm. At this time, the pressure P is gradually increased. When continuous nail driving is started at T=0, the pressure P in the pressure tank 10A pulsates and is reduced. After five seconds has elapsed, the pressure change ratio $\Delta P2/\Delta T2$ is calculated, and since $\Delta P2/\Delta T2=-0.9$, N3=3600 rpm is selected from the rotation speed shift determination table. Therefore, up to T=5 seconds, the motor 33 is rotated at the intermediate speed N2=2400 rpm, and thereafter, is changed to the high speed N3 of 3600 rpm. However, during the five second period, the pressure P in the pressure tank 10A is considerably reduced.

According to the curve (b') as well as the curve (b), up to time T=0, the pressure P in the pressure tank 10A is 26 kg/cm$^2$ or smaller, compressed air is not consumed, and the motor 33 is rotated at the intermediate speed N2=2400 rpm. When continuous nail driving has been started at T=0, and $\Delta T1$=0.05 second has elapsed, the pressure change ratio is calculated because the ripple detection is performed in this case. Since $\Delta P1/\Delta T1=-4<-1$, it is determined that the ripple is large. Furthermore, since the power supply voltage V is 90 V or higher, the load current I is 30 A or smaller and the motor winding temperature t is 120 or lower, after $\Delta T1$=0.05 second has elapsed, the motor 33 is shifted immediately to the high speed N3=3600 rpm. Therefore, compared with the case of the curve (b), the reduction in the pressure in the pressure tank 10A can be suppressed, and substantially the same pressure level as at T=0 can be maintained after the continuous nail driving is started.

No detailed explanation will be given for the operations of the air compressor of the invention in the silent mode and the powerful mode. That is, in the same manner as in the automatic mode, when the tank pressure change ratio for a short period is greater than a predetermined value, the motor 33 is activated without permitting a reduction in the pressure to a predetermined level. Therefore, when a large amount of compressed air is consumed for an operation such as continuous nail driving, the reduction in the pressure in the pressure tank 10A can be suppressed.

As is apparent from the explanation for the air compressor of this invention, when the rotation speed of the motor for driving the air compressed generator is N0, N1, N2 or N3 (N0=0, N0<N1<N2<N3), a user can select a desired mode from the silent mode for rotating the motor at the rotation speed of N0 or N1, the powerful mode for rotating the motor at the rotation speed of N0, N2 or N3, and the automatic mode for rotating the motor at the rotation speed of N0, N1, N2 or N3. Therefore, the air compressor can cope with various usage environments, such as an environment for which a high speed and high power are important, an environment for which low noise is important, and an environment for which a balance between noise and power should be adjusted in accordance with the pneumatic tool that is employed.

When the automatic mode is selected, multiple levels are designated for the rotation speed of the motor, and the pressure detected by the pressure sensor of the pressure tank is employed to calculate the pressure change ratio each time a short period, such as 0.05 second, has elapsed, and the pressure change ratio each time a long period, such as five seconds, has elapsed. Based on these pressure change ratios, the rotation speed of the motor is controlled. Therefore, when the air compressor is in the standby state and the only air consumption is that resulting from natural air leakage, or when only a small amount of air is required because a tool such as a small air tacker is being used, the motor need only be rotated at a lower speed, and the noise can be reduced.

When a large amount of air is consumed in a short period of time, e.g., when continuous nail driving is performed using a large nailer, the rotation speed of the motor is shifted immediately to the high speed, and a reduction in the pressure in the pressure tank can be suppressed. Therefore, for the continuous driving of concrete nails, or wood nails having a large diameter, the frequency at which the poor nail holding phenomenon occurs can be reduced. Further, even when there is a temporary occurrence of this phenomenon, the period affected is extremely shortened.

In addition, when a large ripple in the pressure in the pressure tank is detected and the motor is shifted to the high rotation speed, the previous rotation speed is maintained at least for a predetermined period (e.g., five seconds). Therefore, frequent switching of the rotation speed of the motor within a short period of time can be avoided, and provision of an uncomfortable sensation can be suppressed.

What is claimed is:

1. An air compressor, comprising:

a tank unit storing compressed air;

a compressed air generator generating the compressed air to be supplied to the tank unit;

a drive portion including a motor for driving the compressed air generator; and a controller portion controlling the drive portion, wherein the motor is controlled to run at one of multiple levels of rotational speeds, the levels including rotational speeds of N0, N1, N2 and N3 where N0=0, and N0<N1<N2<N3, said controller portion being adapted to control the drive portion at different operating modes, the operating modes including at least two operating modes selected from a group consisting of a silent mode operating the motor at a rotational speed of N0 or N1, a powerful mode operating the motor at a rotational speed of N0, N2 or N3, and an automatic mode operating the motor at a rotational speed of N0, N1, N2 or N3; and an operating mode selection switch that selects one of said at least two operating modes of the group of the silent mode, the powerful mode and the automatic mode.

2. The air compressor according to claim 1, further comprising:

a pressure sensor detecting a pressure in the tank unit, wherein the rotational speed of the motor in a selected mode is changed based on a signal output by the pressure sensor.

3. An air compressor, comprising:

a tank unit storing compressed air;

a compressed air generator generating the compressed air to be supplied to the tank unit;

a drive portion including a motor for driving the compressed air generator;

a controller portion controlling the drive portion, wherein the motor is controlled to run at one of multiple levels of rotational speed, said controller portion being adapted to control the drive portion at different operating modes, the operating modes including at least two modes selected from a group consisting of a first mode switching the motor between at least two rotational speeds including 0, a second mode switching the motor between at least three rotational speeds including 0, and a third mode switching the motor between at least four rotational speeds including 0 are enabled, and an operating mode selection switch that selects one of said at least two operating modes selected from the group of the first mode, the second mode and the third mode.

4. The air compressor according to claim 3, further comprising:

a pressure sensor detecting a pressure in the tank unit, wherein the rotational speed of the motor in a selected mode is changed based on a signal output by the pressure sensor.

5. An air compressor, comprising:

a tank unit storing compressed air;

a compressed air generator generating the compressed air to be supplied to the tank unit;

a drive portion including a motor for driving the compressed air generator;

a controller portion controlling the drive portion, wherein the motor speed is controlled to run at one of multiple levels of rotational speeds, the levels including rotational speeds of N0, N1, N2 and N3 where N0=0, and N0<N1<N2<N3, said controller portion adapted to control the drive portion at different operating modes, the operating modes including at least two operating modes selected from a group consisting of a silent mode operating the motor at rotational speed of N0 or N1, a powerful mode operating the motor at a rotational speed of N0, N2 or N3, and an automatic mode operating the motor at a rotational speed of N0, N1, N2 or N3;

a pressure sensor detecting a pressure in the tank unit, wherein the pressure sensor detects a pressure P in the tank unit at a predetermined period ΔT interval to obtain ΔP/ΔT, which is a ratio of a pressure change ΔP to the predetermined period ΔT, and the rotational speed of the motor in a selected mode is changed on the basis of the pressure P of the tank unit and the ratio of the ΔP/ΔT.

6. The air compressor according to claim 5, wherein a detection signal P output by the pressure sensor is calculated to obtain ΔP1/ΔT1, which is the pressure change ratio for an internal pressure of the tank unit during a relatively short period ΔT1, and ΔP2/ΔT2, which is the pressure change ratio for the internal pressure of the tank unit during a period ΔT2 that is longer than ΔT1 and, based on information for P, ΔP1/ΔT1 and ΔP2/ΔT2, the rotational speed of the motor in the automatic mode is changed.

7. The air compressor according to claim 5, wherein a detection signal P output by the pressure sensor is calculated to obtain ΔP1/ΔT1, which is the pressure change ratio for an internal pressure of the tank unit during a relatively short period ΔT1 and based on information for P and ΔP1/ΔT1, the rotational speed of the motor in silent mode is changed.

8. The air compressor according to claim 5, wherein a detection signal P output by the pressure sensor is calculated to obtain ΔP1/ΔT1, which is the pressure change ratio for an internal pressure of the tank unit during a relatively short period ΔT1 and based on the information for P and ΔP1/ΔT1, the rotation speed of the motor in the powerful mode is changed.

9. An air compressor, comprising:

a tank unit storing compressed air;

a compressed air generator generating the compressed air to be supplied to the tank unit;

a drive portion including a motor for driving the compressed air generator;

a controller portion controlling the drive portion, wherein at least two modes selected from a group consisting of a first mode switching the motor between at least two rotational speeds including 0, a second mode switching the motor between at least three rotational speeds including 0, and a third mode switching the motor between at least four rotational speeds including 0 are enabled; and a pressure sensor detecting a pressure in the tank unit, wherein a detection signal P output by the pressure sensor is calculated to obtain ΔP1/ΔT1, which is the pressure change ratio forth an internal pressure of the tank unit during a relatively short period ΔT1, and ΔP2/ΔT2, which is the pressure change ratio for the internal pressure of the tank unit during a period ΔT2 that is longer than ΔT1 and, based on information for P, ΔP1/ΔT1 and ΔP2/ΔT2, the rotational speed of the motor in the third mode is changed.

10. The air compressor according to claim 9, wherein the controller portion includes a memory storing information which represents a relationship of the pressure P in the tank unit, a pressure change ratio ΔP2/ΔT2 and a motor rotational speed N, wherein the motor rotational speed is determined by searching the memory.

11. An air compressor, comprising:

a tank unit storing compressed air;

a compressed air generator generating the compressed air to be supplied to the tank unit;

a drive portion including a motor for driving the compressed air generator;

a controller portion controlling the drive portion, wherein at least two modes selected from a group consisting of a first mode switching the motor between at least two rotational speeds including 0, a second mode switching the motor between at least three rotational speeds including 0, and a third mode switching the motor between at least four rotational speeds including 0 are enabled; and a pressure sensor detecting a pressure in the tank unit, wherein a detection signal P output by the pressure sensor is calculated to obtain ΔP1/ΔT1, which is the pressure change ratio for an internal pressure of the tank unit during a relatively short period ΔT1 and based on the information for P and ΔP1/ΔT1, the rotational speed of the motor in the first mode is changed.

12. The air compressor according to claim 11, further comprising at least one of a temperature sensor detecting temperature of the motor, a voltage sensor detecting a power voltage of the drive portion and a current sensor detecting a current load flowing through the drive portion, wherein the rotational speed of the motor is changed based on information contained in detection signals output by each of the sensor, the voltage sensor, and the current sensor.

13. An air compressor, comprising:

a tank unit storing compressed air;

a compressed air generator generating the compressed air to be supplied to the tank unit;

a drive portion including a motor for driving the compressed air generator;

a controller portion controlling the drive portion, wherein at least two modes selected from a group consisting of a first mode switching the motor between at least two rotational speeds including 0, a second mode switching the motor between at least three rotational speeds including 0, and a third mode switching the motor between at least four rotational speeds including 0 are enabled; and a pressure sensor detecting a pressure in the tank unit, wherein a detection signal P output by the pressure sensor is calculated to obtain ΔP1/ΔT1, which is the pressure change ratio for an internal pressure of the tank unit during a relatively short period ΔT1 and based on the information for P and ΔP1/ΔT1, the rotational speed of the motor in the second mode is changed.

* * * * *